US009011196B2

(12) United States Patent
Weisman et al.

(10) Patent No.: US 9,011,196 B2
(45) Date of Patent: Apr. 21, 2015

(54) DEVELOPMENTAL ACTIVITY GYM FOR BABIES

(71) Applicant: Global Marketing Enterprise (GME) Ltd., Tel Aviv (IL)

(72) Inventors: Zafrira Weisman, Tel Aviv (IL); Roni Golos, Tel Aviv (IL)

(73) Assignee: Global Marketing Enterprise (GME) Ltd., Tel Aviv (IL)

( * ) Notice: Subject to any disclaimer, the term of this patent is extended or adjusted under 35 U.S.C. 154(b) by 145 days.

(21) Appl. No.: 13/835,021

(22) Filed: Mar. 15, 2013

(65) Prior Publication Data

US 2014/0273719 A1 Sep. 18, 2014

(51) Int. Cl.

| | |
|---|---|
| ***A63H 33/00*** | (2006.01) |
| *A47D 9/00* | (2006.01) |
| *A63H 19/00* | (2006.01) |

(52) U.S. Cl.

CPC ..... *A63H 33/006* (2013.01); *A47D 9/005* (2013.01); *A63H 19/00* (2013.01)

(58) Field of Classification Search

USPC ..... 5/655; 446/227

See application file for complete search history.

(56) References Cited

U.S. PATENT DOCUMENTS

| | | | | |
|---|---|---|---|---|
| 1,622,613 | A | 3/1927 | Stamos | |
| 2,243,238 | A | 5/1941 | Wood | |
| 2,774,182 | A * | 12/1956 | Beder | 446/227 |
| 3,540,153 | A | 11/1970 | Aoki | |
| 3,562,950 | A | 2/1971 | Genin | |
| 3,688,436 | A | 9/1972 | Kazuo | |
| 4,189,864 | A | 2/1980 | Saito | |
| 4,217,727 | A | 8/1980 | Fetty | |
| 4,222,195 | A | 9/1980 | Kurosawa | |
| 4,222,915 | A | 9/1980 | Wolff | |
| 4,237,648 | A | 12/1980 | Moe | |
| 4,404,980 | A | 9/1983 | Wade | |
| 4,565,538 | A | 1/1986 | Kennedy | |
| 4,573,943 | A | 3/1986 | Kennedy | |
| 4,664,640 | A | 5/1987 | Shindo | |
| 4,833,837 | A | 5/1989 | Bonneau | |
| 5,035,013 | A * | 7/1991 | Bloom | 5/420 |
| 5,117,852 | A | 6/1992 | Bryant | |

(Continued)

FOREIGN PATENT DOCUMENTS

| | | |
|---|---|---|
| CA | 1164903 | 4/1984 |
| DE | 2749472 | 6/1978 |

(Continued)

*Primary Examiner* — John Ricci

(74) *Attorney, Agent, or Firm* — Sughrue Mion, PLLC

(57) ABSTRACT

A developmental toy for infants including an infant support surface having an open and a folded operative orientation, a first pair of circumferential elements associated therewith and having an open and a folded operative orientation and a second pair of elements, generally similar in configuration to the first pair of circumferential elements, arranged to support toy objects above the infant support surface and having an open and a folded operative orientation and a locking assembly for selectably locking the first and second pairs of circumferential elements in their respective open operative orientations, the open operative orientation of the infant support surface being an angular separation of 180 degrees, the open operative orientation of the first pair of circumferential elements being an angular separation of 180 degrees and the open operative orientation of the first pair of circumferential elements being an angular separation of substantially less than 180 degrees.

24 Claims, 28 Drawing Sheets

(56) References Cited

U.S. PATENT DOCUMENTS

| | | | | |
|---|---|---|---|---|
| 5,308,274 | A | 5/1994 | Watrobka | |
| 5,427,561 | A | 6/1995 | Eichhorn | |
| 5,441,435 | A | 8/1995 | Shiraishi | |
| 5,632,107 | A | 5/1997 | Meng-Suen | |
| 5,694,655 | A | 12/1997 | Shepler | |
| 5,791,253 | A | 8/1998 | Schultheis | |
| 5,813,349 | A | 9/1998 | Jensen | |
| 5,961,149 | A | 10/1999 | Hunt | |
| 5,980,358 | A | 11/1999 | Diller | |
| 6,089,951 | A | 7/2000 | Ostendorff | |
| 6,332,290 | B1 | 12/2001 | Delamare | |
| 6,358,112 | B1 | 3/2002 | Lambert | |
| 6,389,624 | B1 * | 5/2002 | Madole | 5/655 |
| 6,439,955 | B1 | 8/2002 | Feketo | |
| 6,702,643 | B1 * | 3/2004 | Drosendahl et al. | 446/227 |
| 7,062,146 | B2 | 6/2006 | Elias | |
| 7,841,356 | B2 | 11/2010 | Shires | |
| 2003/0066550 | A1 | 4/2003 | Al-Ghamdi | |
| 2004/0266312 | A1 | 12/2004 | Oren et al. | |
| 2005/0194028 | A1 | 9/2005 | Shinner | |
| 2006/0123540 | A1 | 6/2006 | Hoffman | |
| 2006/0253987 | A1 | 11/2006 | Solomon | |
| 2007/0066446 | A1 | 3/2007 | Gelfond | |
| 2007/0245491 | A1 | 10/2007 | Korbonski | |
| 2008/0113581 | A1 | 5/2008 | Jazenski | |
| 2009/0205140 | A1 | 8/2009 | Reese | |
| 2009/0253342 | A1 | 10/2009 | Oren | |
| 2011/0065353 | A1 | 3/2011 | Chininis | |

FOREIGN PATENT DOCUMENTS

| | | |
|---|---|---|
| EP | 0641581 | 9/1993 |
| EP | 1116461 | 8/1998 |
| EP | 1550491 | 7/2005 |
| GB | 2471564 | 1/2011 |
| WO | 99/08572 | 2/1999 |
| WO | 01/51155 | 7/2001 |
| WO | 2004/057994 | 7/2004 |
| WO | 2005/054486 | 6/2005 |
| WO | 2005/076842 | 8/2005 |
| WO | 2005/087055 | 9/2005 |
| WO | 2007/026359 | 3/2007 |
| WO | 2009/050695 | 4/2009 |

* cited by examiner 130
343
310
348
346
302
332

302
310
314
348
346

310
312
304
306

320
322
314
490
302
668
524
526
492
490
342
520
318
316
314
322

343
348
790
792
346
310
790
790
302
332
790

314
790
792
348
346
310
790
790
302

342
490
492
526
524
668
520
318
322
316
314
312
792
304
306
492
312
490
320
322
314
310

310
302
320
322
318
306
304
490

342
490
492
526
524
668
520
322
314
316
318
348
346
314
310
302
302

DEVELOPMENTAL ACTIVITY GYM FOR BABIES

FIELD OF THE INVENTION

The present invention relates to toys generally and more particularly to activity centers for young children.

BACKGROUND OF THE INVENTION

Various types of activity centers for young children are known.

SUMMARY OF THE INVENTION

The present invention seeks to provide an improved activity center for young children.

There is thus provided in accordance with a preferred embodiment of the present invention a developmental toy for infants including an infant support surface having an open operative orientation and a folded operative orientation, a first pair of circumferential elements associated with the infant support surface and having an open operative orientation and a folded operative orientation and a second pair of elements, generally similar in configuration to the first pair of circumferential elements, arranged to support toy objects above the infant support surface and having an open operative orientation and a folded operative orientation and a locking assembly for selectably locking the first and second pairs of circumferential elements in their respective open operative orientations, the open operative orientation of the infant support surface being an angular separation of 180 degrees, the open operative orientation of the first pair of circumferential elements being an angular separation of 180 degrees and the open operative orientation of the first pair of circumferential elements being an angular separation of substantially less than 180 degrees.

Preferably, the developmental toy for infants also includes a track assembly including an upper track portion and a lower track portion which are fixed together to define a top track lying above the upper track portion, an intermediate track lying between the top track portion and the lower track portion and a bottom track lying below the lower track portion and a locomotive assembly including a top portion which moves along the top track.

In accordance with a preferred embodiment of the present invention the developmental toy for infants also includes at least one removably mounting element operative for removably mounting the track assembly on the second pair of elements. Additionally or alternatively, the developmental toy for infants also includes at least one removably mounting element operative for removably mounting the track assembly on the infant support surface.

Preferably, the locomotive assembly also includes an intermediate portion which is decouplably connected to the top portion for travel along the intermediate track along with the top portion and a bottom portion which is fixed to the intermediate portion for travel along with the intermediate portion. Additionally, the intermediate portion of the locomotive assembly is at least lockable in an at least partially confined space between the upper track portion and a lower track portion and is thus retained against disengagement from the track assembly even when the intermediate portion is decoupled from the top portion of the locomotive assembly.

In accordance with a preferred embodiment of the present invention the top portion of the locomotive assembly is operative to move along the top track and to provide a rotational driving output about an axis which is generally perpendicular to the track, the intermediate portion of the locomotive assembly is operative to be decouplably driven by the top portion both in motion along the intermediate track and in rotational motion about the axis which is generally perpendicular to the track and the bottom portion of the locomotive assembly is operative to be driven by the intermediate portion both in motion along the bottom track and in rotational motion about the axis which is generally perpendicular to the track.

Preferably, the developmental toy for infants also includes a base assembly including an upper base portion and a lower base portion which are fixed together to define a top base surface lying above the upper base portion, an at least partially confined base surface lying between the top base portion and the lower base portion and a bottom base surface lying below the lower base portion and a motion assembly including a top portion which moves in a first manner on the top base surface.

In accordance with a preferred embodiment of the present invention the motion assembly also includes an intermediate portion which is decoublably connected to the top portion for movement on the at last partially confined base surface driven by the top portion and a bottom portion which is fixed to the intermediate portion for movement along with the intermediate portion.

Preferably, the developmental toy for infants also includes at least one removably mounting element operative for removably mounting the base assembly on the infant support surface. Additionally or alternatively, the developmental toy for infants also includes at least one removably mounting element operative for removably mounting the track assembly on the second pair of elements.

In accordance with a preferred embodiment of the present invention the motion assembly also includes an intermediate portion which is decoublably connected to the top portion for movement on the at last partially confined base surface driven by the top portion and a bottom portion which is fixed to the intermediate portion for movement along with the intermediate portion.

Preferably, the developmental toy for infants also includes an elongate track and a vehicle configured for locomotive motion along the track within a field of view of an infant located on the infant support surface, the locomotive motion along the track being generally side to side motion in the infant's field of view.

In accordance with a preferred embodiment of the present invention the vehicle includes a support for a depending visual attractant. Additionally, the vehicle includes a rotating support for the depending visual attractant, causing rotation of the visual attractant about an axis transverse to that of the elongate track.

There is also provided in accordance with another preferred embodiment of the present invention a developmental toy for infants including a base assembly including an upper base portion and a lower base portion which are fixed together to define a top base surface lying above the upper base portion, an at least partially confined base surface lying between the top base portion and the lower base portion and a bottom base surface lying below the lower base portion and a motion assembly including a top portion which moves in a first manner on the top base surface, an intermediate portion which is decoublably connected to the top portion for movement on the at last partially confined base surface driven by the top portion and a bottom portion which is fixed to the intermediate portion for movement along with the intermediate portion.

There is further provided in accordance with yet another preferred embodiment of the present invention a developmental toy for infants including a track assembly including an upper track portion and a lower track portion which are fixed together to define a top track lying above the upper track portion, an intermediate track lying between the top track portion and the lower track portion and a bottom track lying below the lower track portion and a locomotive assembly including a top portion which moves along the top track, an intermediate portion which is decouplably connected to the top portion for travel along the intermediate track along with the top portion and a bottom portion which is fixed to the intermediate portion for travel along with the intermediate portion.

Preferably, the intermediate portion of the locomotive assembly is at least lockable in an at least partially confined space between the upper track portion and a lower track portion and is thus retained against disengagement from the track assembly even when the intermediate portion is decoupled from the top portion of the locomotive assembly. Additionally, the top portion of the locomotive assembly is operative to move along the top track and to provide a rotational driving output about an axis which is generally perpendicular to the track, the intermediate portion of the locomotive assembly is operative to be decouplably driven by the top portion both in motion along the intermediate track and in rotational motion about the axis which is generally perpendicular to the track and the bottom portion of the locomotive assembly is operative to be driven by the intermediate portion both in motion along the bottom track and in rotational motion about the axis which is generally perpendicular to the track.

There is even further provided in accordance with still another preferred embodiment of the present invention a developmental toy for infants including an infant support surface, an elongate track configured to be mountable at a location raised with respect to the infant support surface and a movable element configured for locomotive motion along the track within a field of view of an infant located on the infant support surface, the locomotive motion along the track being generally side to side motion in the infant's field of view, the movable element being selectably non-detachable from the track by the infant.

Preferably, the developmental toy for infants also includes at least one visual attractant arranged for removable association with the movable element at least for motion therewith along the track.

In accordance with a preferred embodiment of the present invention the infant support surface has an open operative orientation and a folded operative orientation and the developmental toy also includes a first pair of circumferential elements associated with the infant support surface and having an open operative orientation and a folded operative orientation, a second pair of elements, generally similar in configuration to the first pair of circumferential elements, arranged to support toy objects above the infant support surface and having an open operative orientation and a folded operative orientation and a locking assembly for selectably locking the first and second pairs of circumferential elements in their respective open operative orientations, the open operative orientation of the infant support surface being an angular separation of 180 degrees, the open operative orientation of the first pair of circumferential elements being an angular separation of 180 degrees and the open operative orientation of the first pair of circumferential elements being an angular separation of substantially less than 180 degrees.

BRIEF DESCRIPTION OF THE DRAWINGS

The present invention will be understood and appreciated more fully from the following detailed description with reference to the drawings in which.

DETAILED DESCRIPTION OF PREFERRED EMBODIMENTS

Figure 1A:
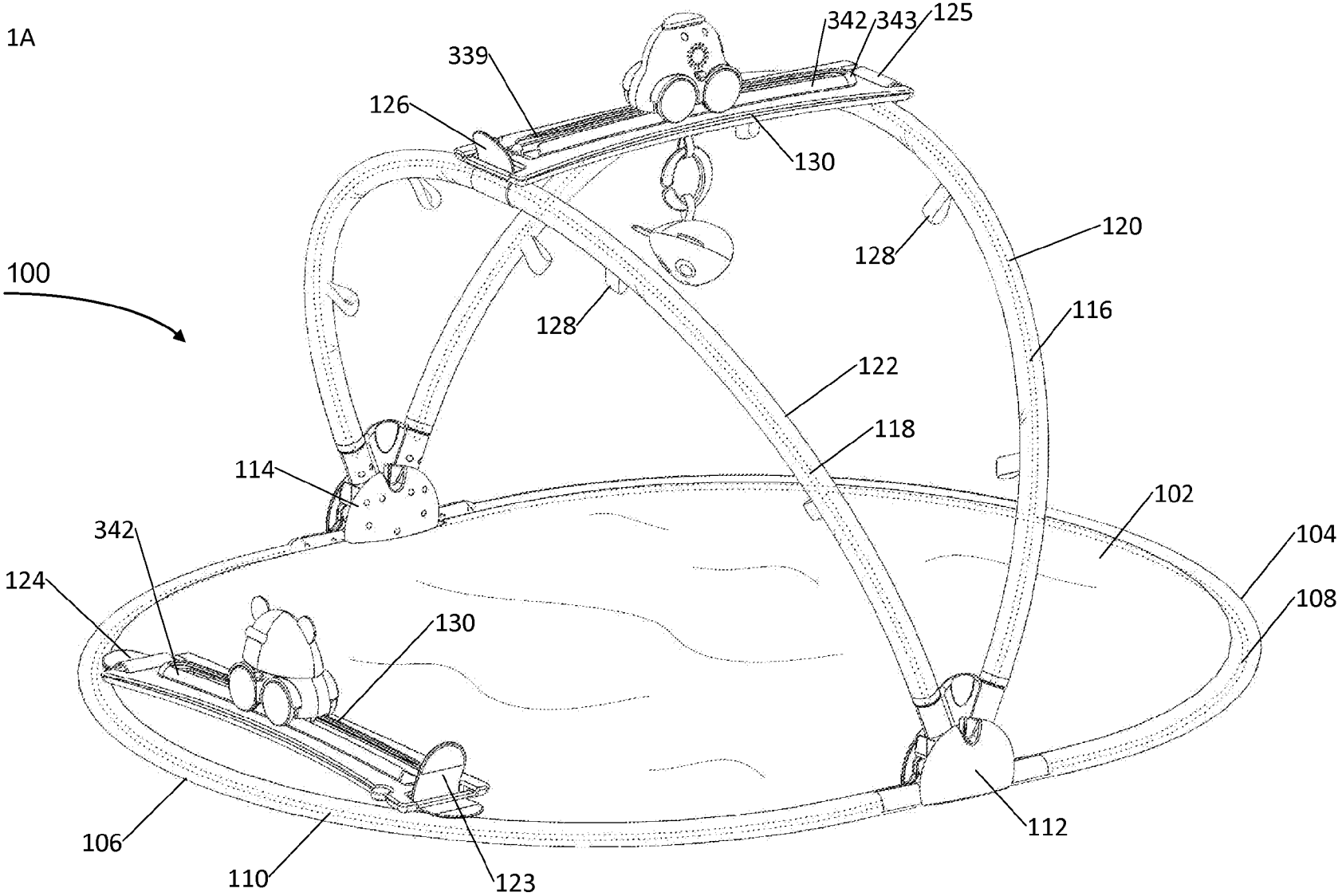
FIG. 1A is a simplified assembled view illustration of a young child activity center constructed and operative in accordance with a preferred embodiment of the present invention.
Figure 1B:
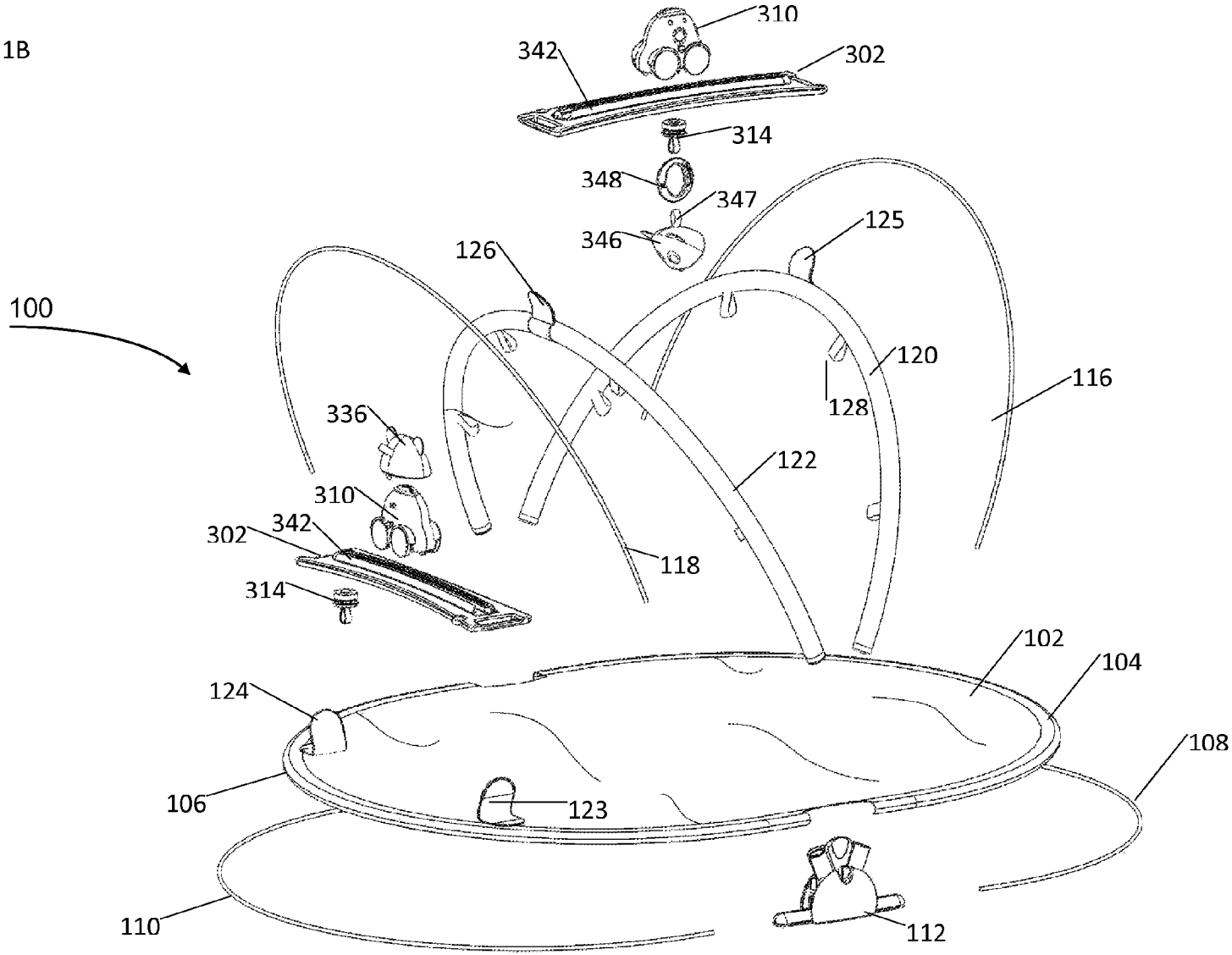
FIG. 1B is a simplified partially exploded view illustration of the activity center of FIG. 1A.

Reference is now made to FIGS. 1A and 1B, which are respective simplified assembled view and partially exploded view illustrations of a young child activity center 100, constructed and operative in accordance with a preferred embodiment of the present invention.

As seen in FIGS. 1A & 1B, the activity center includes a pad 102 having a pair of generally circumferential sleeve pockets 104 and 106 for removably accommodating a pair of arc-shaped elongate elements 108 and 110 respectively. Pad engaging arc shaped elongate elements 108 and 110 are pivotably mounted at their respective ends on a pair of arc mounting and positioning subassemblies 112 and 114, which also pivotably mount a pair of toy object mounting arc shaped elongate elements 116 and 118 at their respective ends. Toy object mounting arc shaped elongate elements 116 and 118 are preferably enclosed in respective sleeves 120 and 122.

Preferably mounted onto pad 102 are a pair of mutually spaced removable decouplable reciprocating and rotating movement subassembly mounting tabs 123 and 124, which preferably have VELCRO® type fasteners formed thereon. Similar removable decouplable reciprocating and rotating movement subassembly mounting tabs 125 and 126 are preferably provided on sleeves 120 and 122 of respective toy object mounting arc shaped elongate elements 116 and 118. Sleeves 120 and 122 of toy object mounting arc shaped elongate elements 116 and 118 are preferably also provided with a plurality of toy object mounting loops 128.

A decouplable reciprocating and rotating movement subassembly 130 may be removably mounted either on tabs 123 & 124 or on tabs 125 & 126. Alternatively, two subassemblies 130 may be provided, as seen also in FIG. 10A.

Figure 2A:
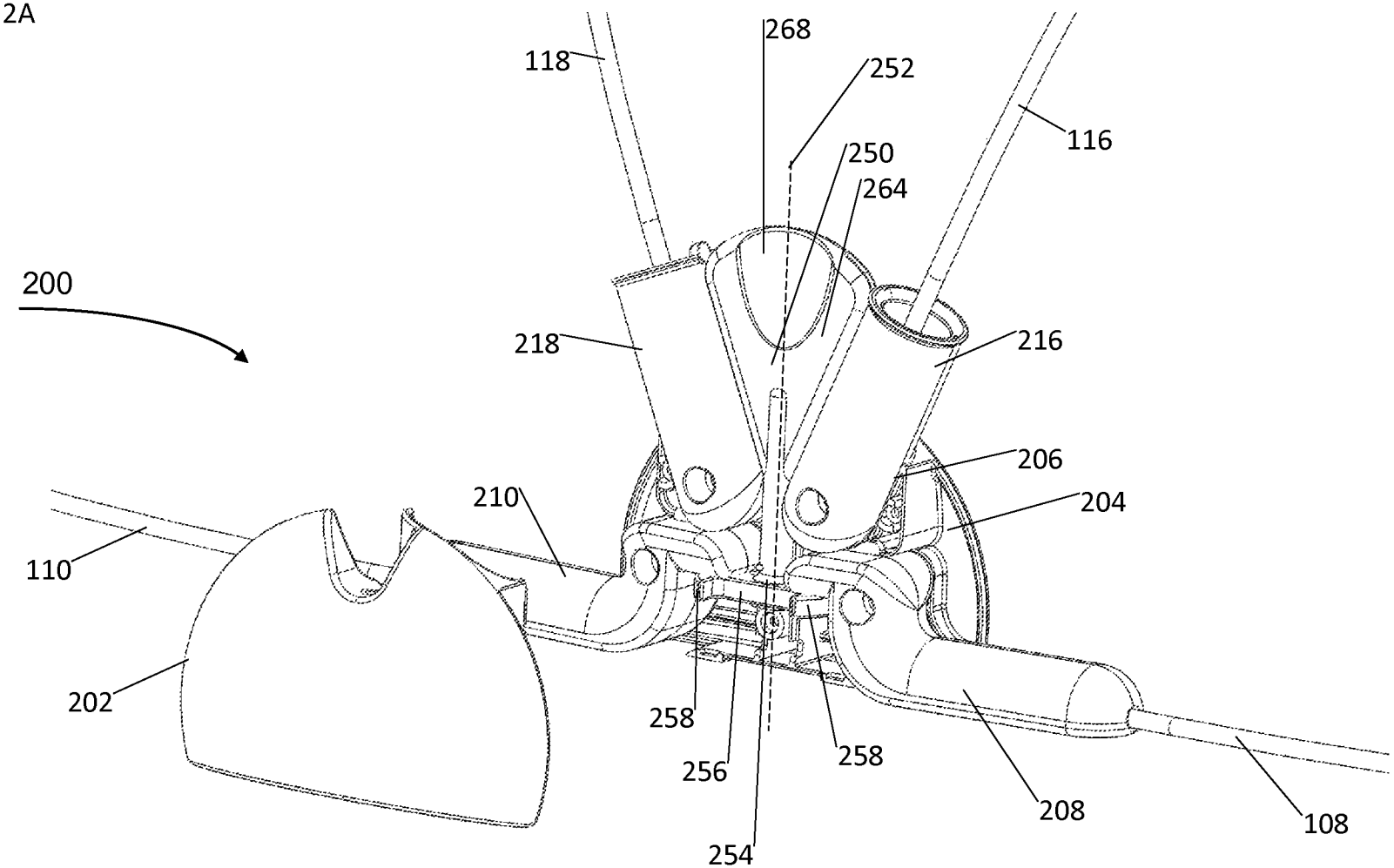
FIG. 2A is a simplified partially assembled view illustration of an arc mounting and positioning subassembly forming part of the activity center of FIGS. 1A & 1B.
Figure 2B:
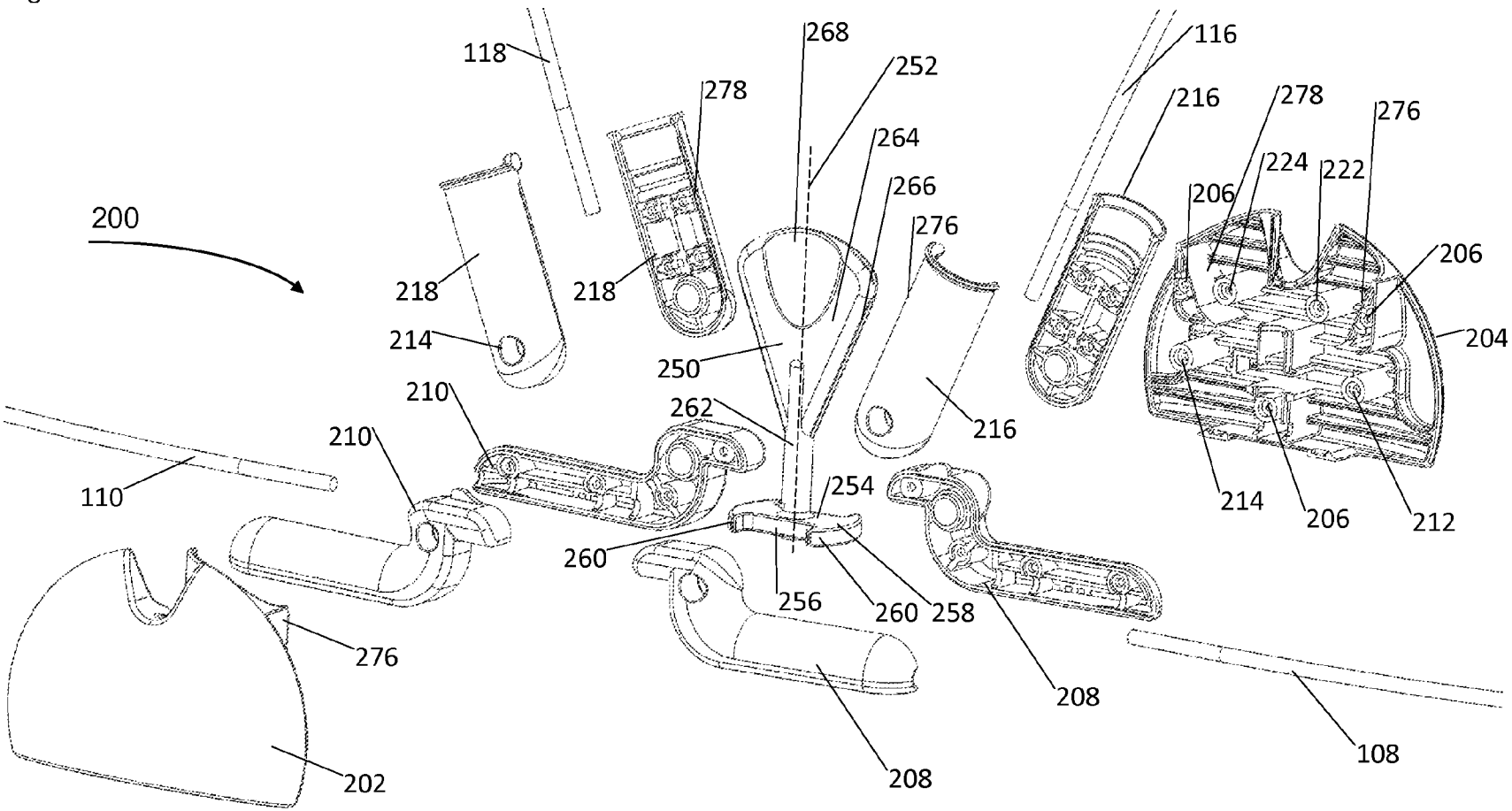
FIG. 2B is a simplified exploded view illustration of the arc mounting and positioning subassembly of FIG. 2A.

Reference is now made to FIGS. 2A and 2B, which are respective simplified partially assembled view and simplified exploded view illustrations of arc mounting and positioning subassembly 200, such as subassemblies 112 and 114, forming part of the activity center of FIGS. 1A & 1B.

As seen in FIGS. 2A and 2B, the arc mounting and positioning subassembly 200 includes a pair of cover plates 202 and 204, which are generally similar and typically held together by screws (not shown) at socket locations 206.

It is seen that pad engaging arc shaped elongate elements 108 and 110 are fixedly mounted at their respective ends onto respective pairs of pivotably mounted pad engaging arc shaped elongate element mounting arm elements 208 and 210, which pairs are pivotably mounted by screws (not shown) at respective pivot axes defined by socket locations 212 and 214 and typically held together by additional screws (not shown).

Similarly, toy object mounting elongate elements 116 and 118 are fixedly mounted at their respective ends onto respective pairs of pivotably mounted toy object mounting arc shaped elongate element mounting arm elements 216 and 218, which pairs are pivotably mounted by screws (not shown) at respective pivot axes defined by socket locations 222 and 224 and typically held together by additional screws (not shown).

A rotatable double locking arbor 250 is rotatably mounted about an axis 252 defined by cover plates 202 and 204. Arbor 250 includes a base portion 254 having a generally rectangular center portion 256, at opposite ends of which are formed concave end portions 258 defining locking surfaces 260. Extending axially upward from base portion 254 along axis 252 is a generally cylindrical shaft portion 262 above which is a generally planar generally fan shaped upper portion 264 having inclined locking edge surfaces 266 and opposite finger engagement surfaces 268.

Referring now additionally to FIGS. 11A-11D, it is appreciated that although pad engaging arc shaped elongate element mounting arm elements 208 and 210 are each able to rotate through 90 degrees, pivotably mounted toy object mounting arc shaped elongate element mounting arm elements 216 and 218 are restricted by respective stop surfaces 276 and 278, defined on both cover plates 202 and 204, preferably to lie within approximately 30 degrees of axis 252.

Figure 11B:
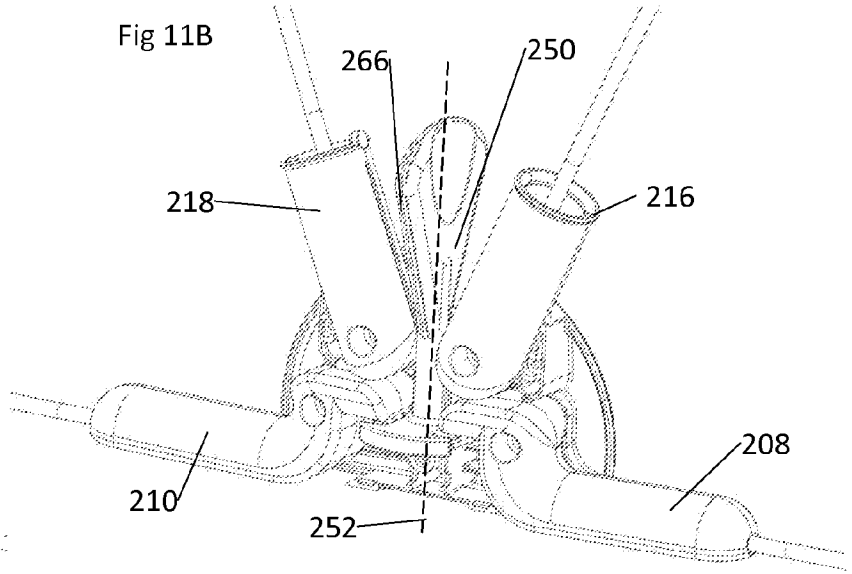
FIGS. 11A, 11B, 11C and 11D are simplified illustrations of the arc mounting and positioning subassembly of FIGS. 2A and 2B of the activity center of FIGS. 1A-12B in the respective fully open and locked, fully open and unlocked, partially folded and fully folded operative orientations of the activity center of FIGS. 1A-12B.
Figure 11D:
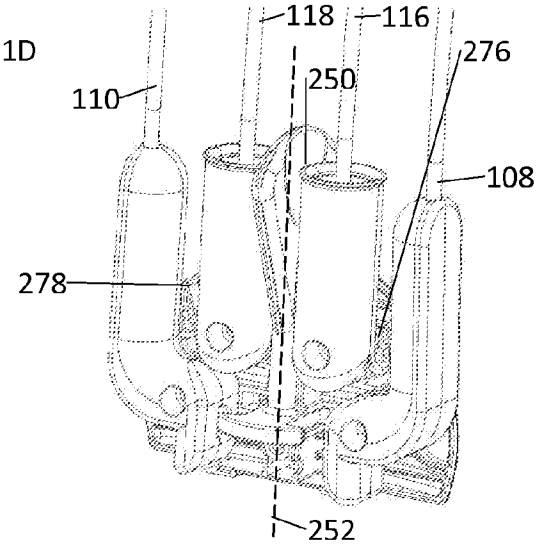
Figure 11A:
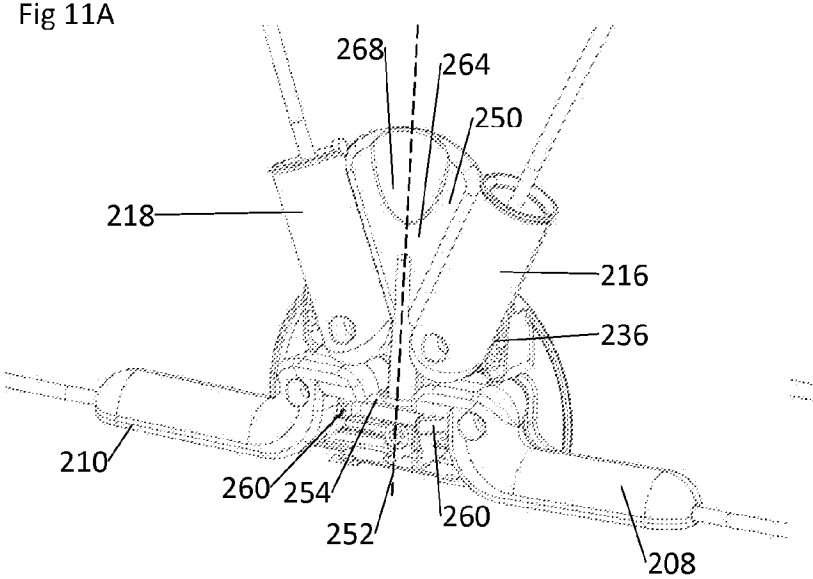

When in a first operative orientation, as shown in FIG. 11A, rotatable arbor 250 prevents rotation of toy object mounting arc shaped elongate element mounting arm elements 216 and 218 towards each other from their position shown in FIGS. 1A and 11A by virtue of engagement thereof with locking surfaces 266 of arbor 250 and thus, cooperating with stop surfaces 276 and 278, retains toy object mounting arc shaped elongate elements 216 and 218 in a desired fixed mutual orientation.

In this first operative orientation, locking surfaces 260 of base portion 254 retain pivotably mounted pad engaging arc shaped elongate element mounting arm elements 208 and 210 in mutually 180 degree orientation, so as to define a stable flat base surface with respect to which toy object mounting arc shaped elongate elements 216 and 218 are retained in a desired fixed mutual orientation.

In a second operative orientation, as seen in FIG. 11B, arbor 250 is rotated about axis 252 by approximately 90 degrees, thus effectively unlocking both pivotably mounted pad engaging arc shaped elongate element mounting arm elements 208 and 210 and toy object mounting arc shaped elongate element mounting arm elements 216 and 218 and permitting rotation thereof about their respective pivot axes.

Figure 11C:
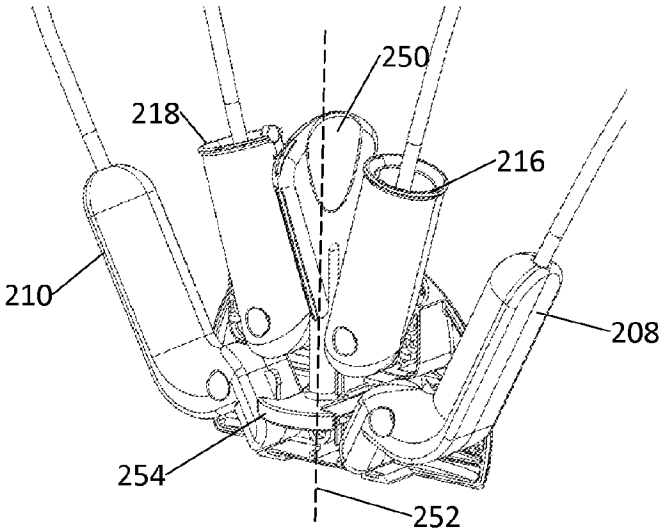

When in a third operative orientation, as shown in FIG. 11C, rotatable arbor 250 remains in its rotated orientation shown in FIG. 11B and both pivotably mounted pad engaging arc shaped elongate element mounting arm elements 208 and 210 and toy object mounting arc shaped elongate element mounting arm elements 216 and 218 are seen to be partially rotated about their respective pivot axes towards axis 252.

FIG. 11D shows a full folded operative orientation wherein all four of arc-shaped elongate elements 108, 110, 116 and 118 lie in generally mutually parallel planes and are thus arranged for ease of transport and storage.

Figure 3A:
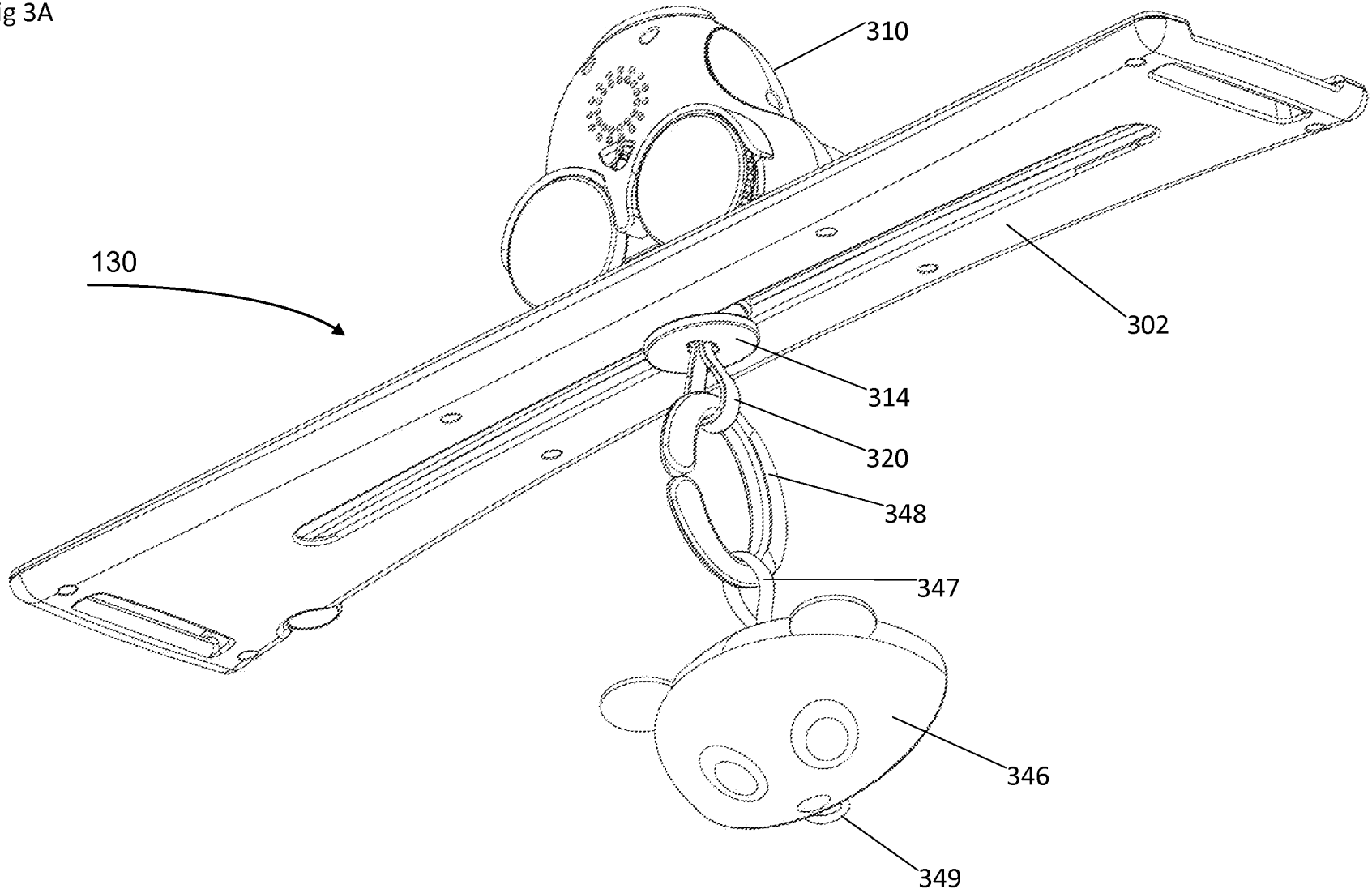
FIG. 3A is a simplified assembled view illustration of decouplable reciprocating and rotating movement subassembly forming part of the activity center of FIGS. 1A & 1B.
Figure 3B:
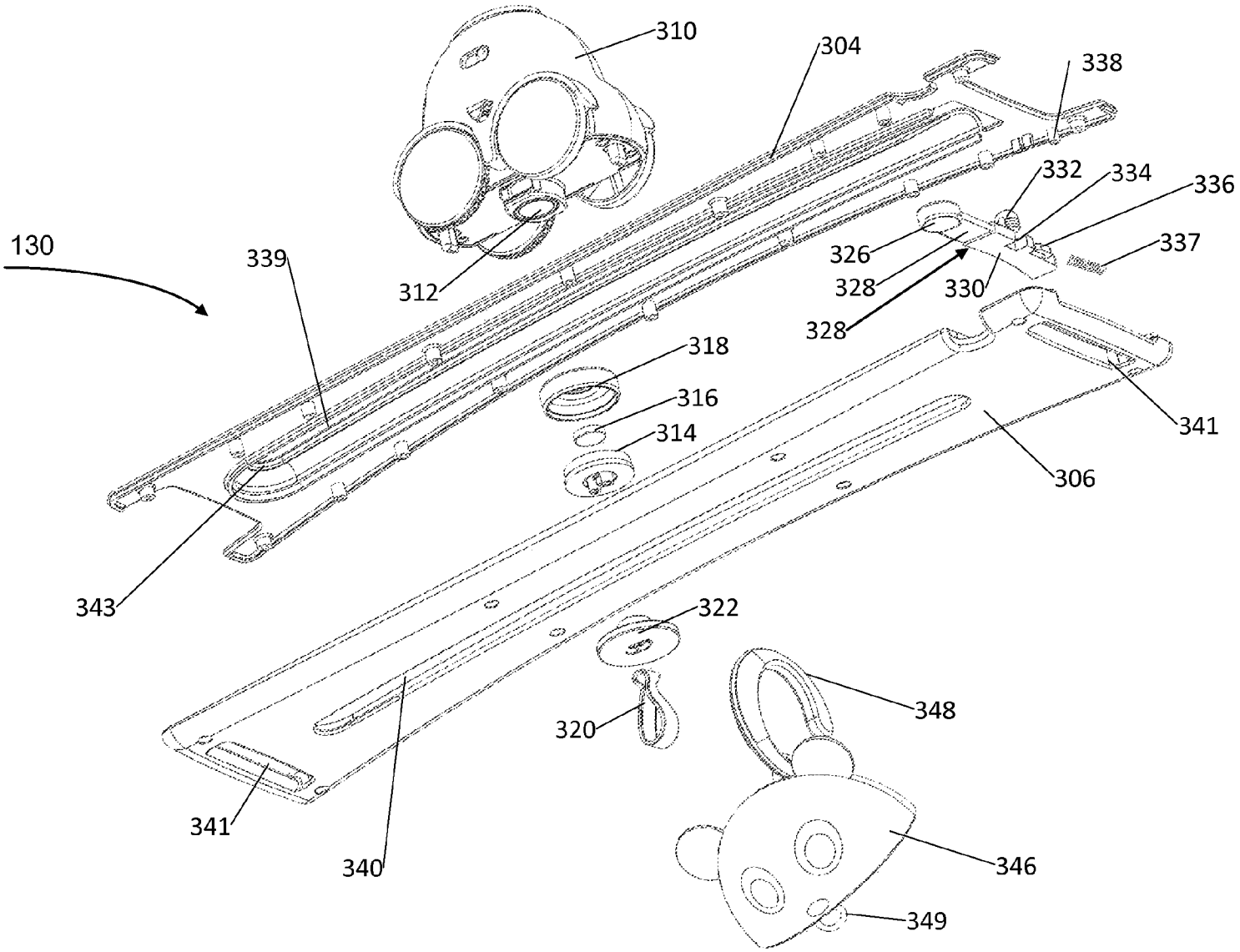
FIG. 3B is a simplified partially exploded view illustration of decouplable reciprocating and rotating movement subassembly forming part of the activity center of FIGS. 1A & 1B.

Reference is now made to FIGS. 3A and 3B, which are respective simplified assembled view and partially exploded view illustrations of decouplable reciprocating and rotating movement subassembly 130 forming part of the activity center of FIGS. 1A & 1B.

As seen in FIGS. 3A and 3B, the decouplable reciprocating and rotating movement subassembly 130 preferably includes a track 302 having top and bottom track portions 304 and 306 which preferably snap together, a multi-axial locomotive 310, which is arranged for reciprocal motion along track 302 and rotational driving of a power take off 312. A decouplable connector assembly 314 is arranged for axial and rotational movement together with power take off 312 and is magnetically coupled thereto in a manner so as to be readily decouplable therefrom but nevertheless retained in track 302.

Decouplable connector assembly 314 preferably includes a magnet 316 enclosed within a top housing portion 318, which also supports a suspension loop 320. The top housing portion 318 is located between top and bottom track portions 304 and 306 and is free to slide along the track 302 and rotate but is not free to disengage from the track 302. A bottom housing portion 322 is located below bottom track portion 306 and is fixed to top housing portion 318 for sliding motion along track 302 and rotation therewith but cannot be disengaged from track 302.

A slidable finger-engageable track end locking element 324 is preferably provided for selectable positioning with respect to bottom track portion 306 for selectable locking of an end of track 302 and thus selectable locking of locomotive 310 against disengagement from track 302. Locking element 324 also functions as a locomotive displacement direction switching engagement element, as will be described hereinbelow.

Slidable finger-engageable track end locking element 324 is a generally elongate element having at a first end thereof, a finger engagement location 326. Extending from finger engagement location is a generally planar connection portion 328 to a base portion 330 which supports a locomotive direction changing switch engagement protrusion 332 having an undercut 334 for accommodating a transverse part 335 of top track portion 304. A spring seat 336 is provided for engaging a first end of a tension spring 337, whose opposite end is seated on a spring seat 338 of top track portion 304 and urges locking element 324 into a normal track locking orientation relative to track 302 in the absence of finger actuation.

Top and bottom track portions 304 and 306 are each formed with a longitudinal slot, here respectively designated by reference numerals 339 and 340. It is noted that bottom track portion 306 is preferably formed with a pair of end slots 341 which accommodate tabs 123 & 124 or tabs 125 & 126. Top track portion 304 is preferably formed with a raised circumferential rim 342 (FIG. 1A) extending along the sides of slot 339 and extending therebetween at an end 343 of slot 339.

Figure 8B:
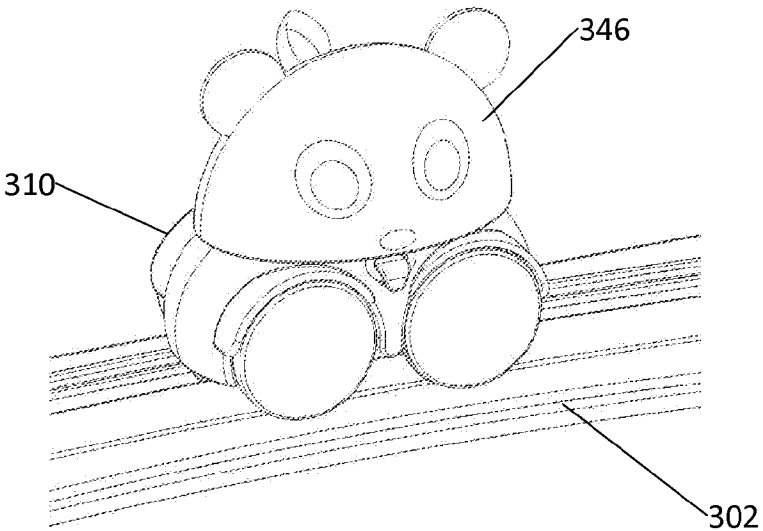
FIGS. 8A and 8B are simplified illustrations of two selectable operative orientations of a fanciful figure and the locomotive of FIGS. 4A-7B.
Figure 8A:
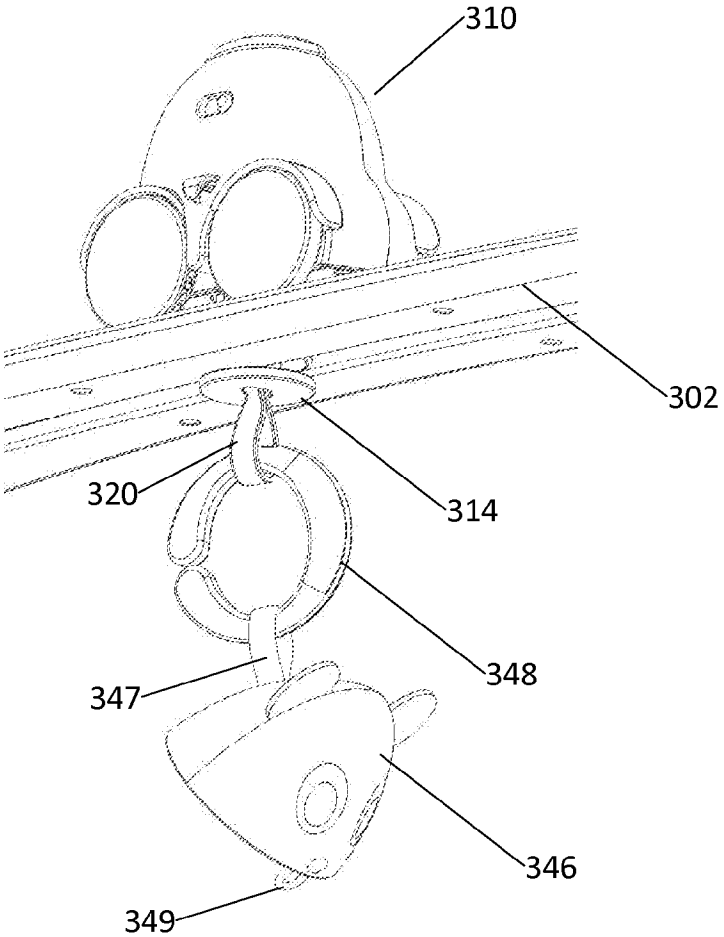
Figure 9B:
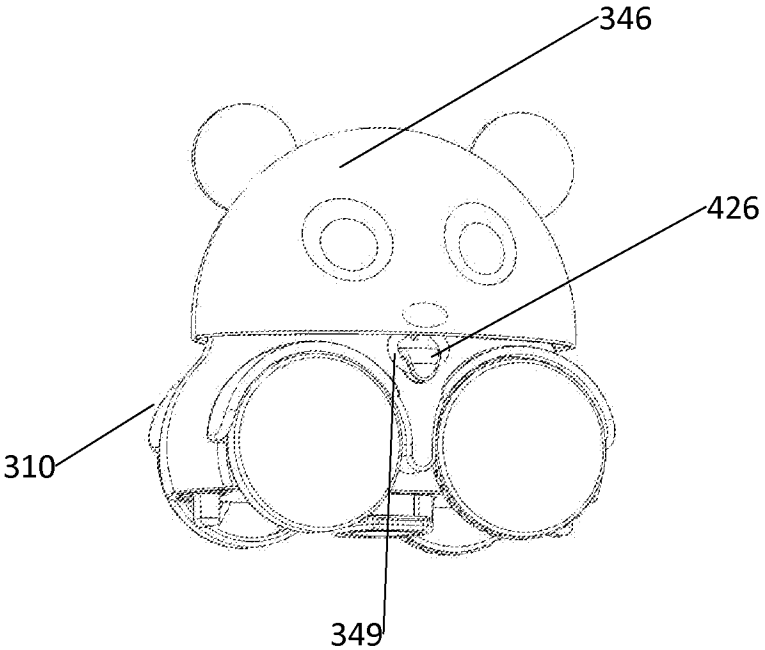
FIGS. 9A and 9B are simplified illustrations of mounting of the fanciful figure onto the locomotive in the operative orientation of FIG. 8B.
Figure 9A:
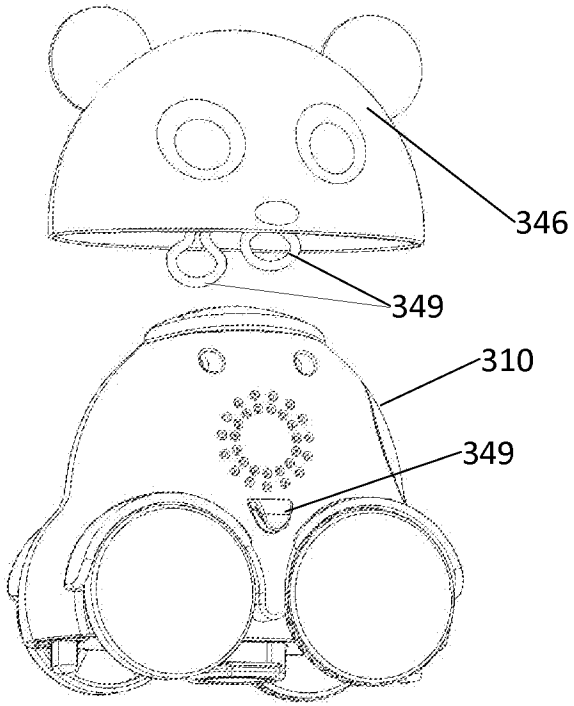

FIGS. 3A and 3B show a dual function rotatable fanciful object 346 having a cap shape and a connection loop 347, which enables it to removably hang from suspension loop 320 of decouplable connector assembly 314 via an optional coupling member 348, for rotation together therewith, as seen in FIGS. 3A, 3B and 8A. Alternatively, fanciful object 336 may be mounted onto locomotive 310 and secured thereto by one or more loops 349, as seen in FIGS. 8B, 9A and 9B.

Figure 4B:
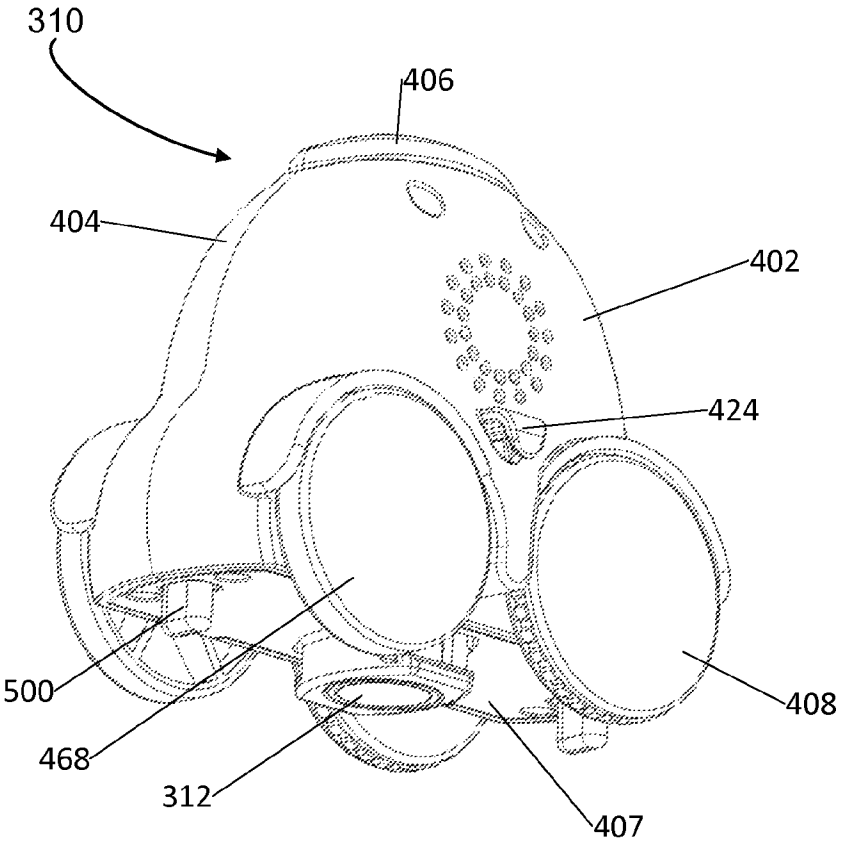
FIGS. 4A & 4B are simplified illustrations, taken from different directions, of a multi-axial locomotive forming part of the decouplable reciprocating and rotating movement subassembly of FIGS. 3A & 3B.
Figure 4A:
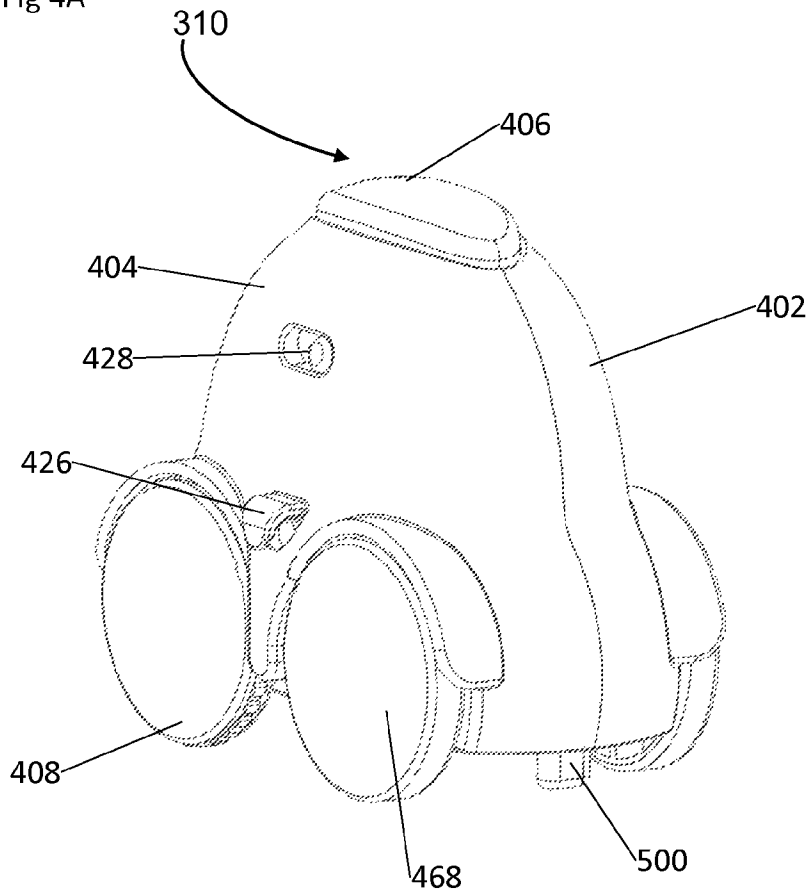
Figure 5A:
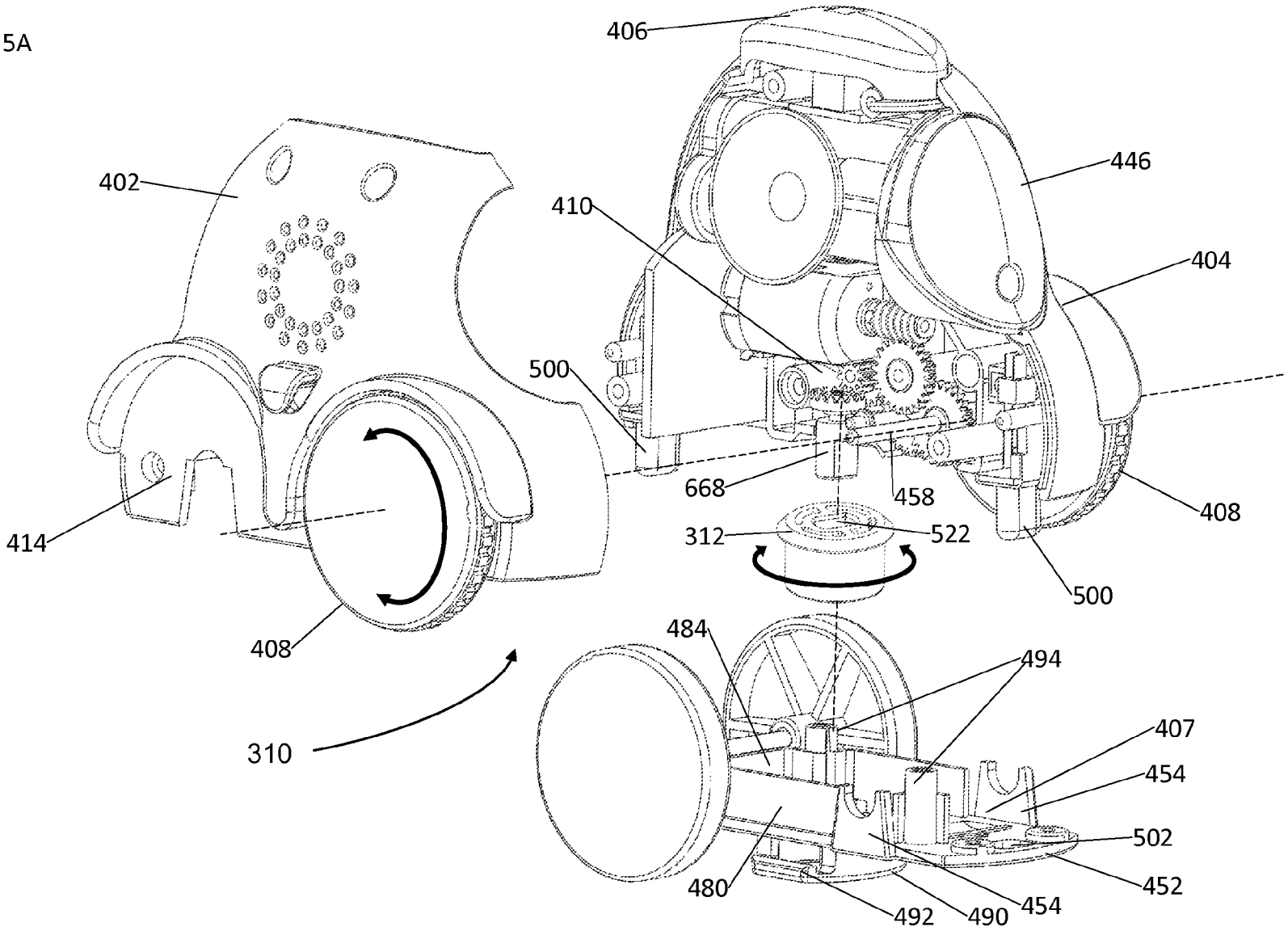
FIGS. 5A & 5B are simplified partially exploded views of the multi-axial locomotive of FIGS. 4A & 4B at different levels of breakdown.
Figure 5B:
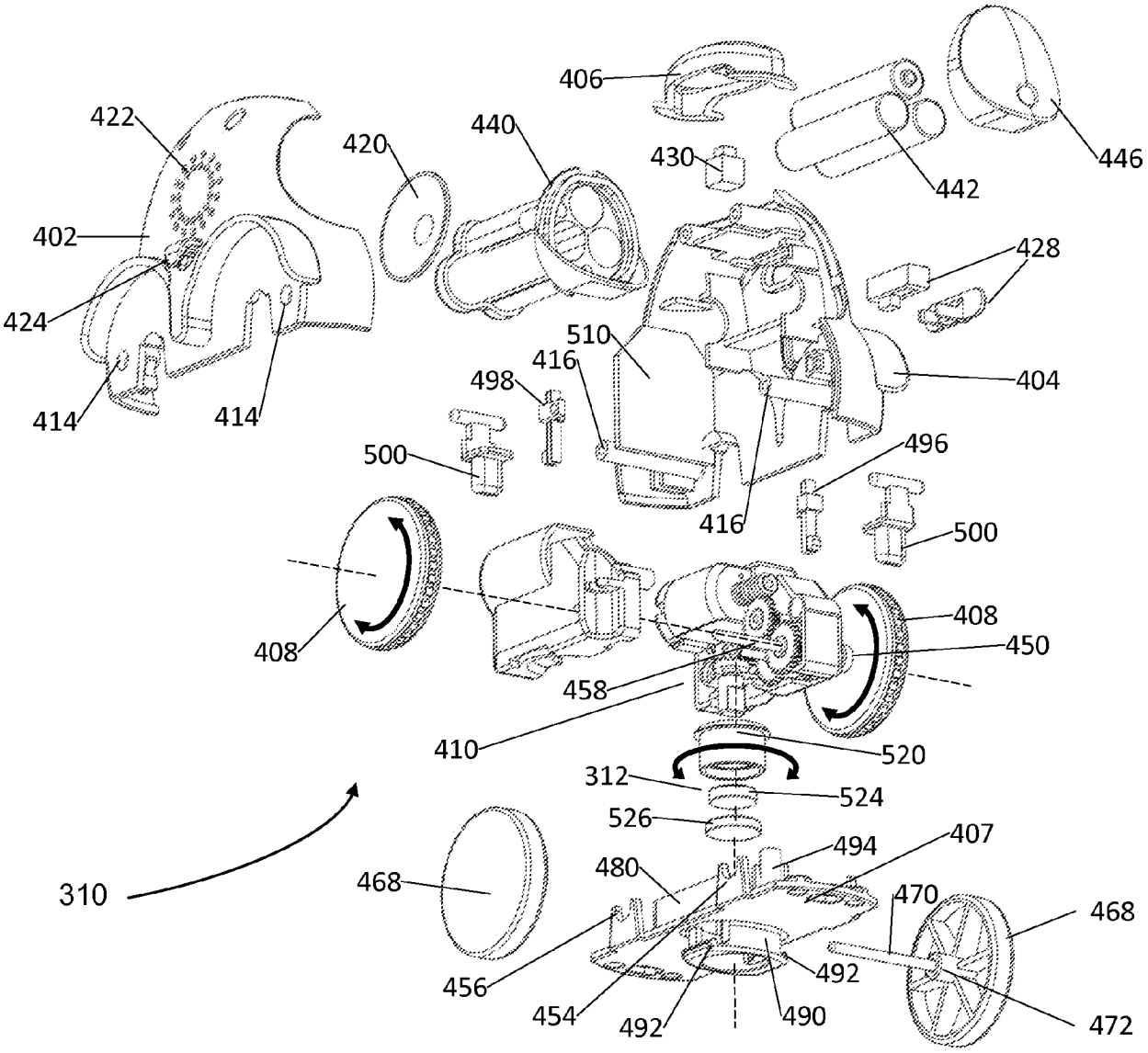

Reference is now made to FIGS. 4A & 4B, which are simplified illustrations, taken from different directions, of a multi-axial locomotive forming part of the decouplable reciprocating and rotating movement subassembly of FIGS. 3A & 3B and to FIGS. 5A & 5B, which are simplified partially exploded views of the multi-axial locomotive 310 of FIGS. 4A & 4B at different levels of breakdown.

As seen in FIGS. 4A, 4B, 5A and 5B, the locomotive 310 preferably comprises first and second side panels 402 and 404, a top element 406, a bottom element 407 and a pair of driven wheels 408, which are driven by a multi-axial gear assembly 410, which also drives power take off 312 (FIGS. 3A & 3B). The first and second side panels 402 and 404 are preferably held together by screws (not shown) which extend through apertures 414 on first side panel 402 and engage respective sockets 416 on second side panel 404.

Mounted within and adjacent to first side panel 402 is a speaker 420, which is preferably aligned with an array 422 of apertures formed in first side panel 402.

First side panel 402 is also preferably formed with a hook 424 and second side panel 404 is formed with a hook 426 for removably retaining loops 349 of fanciful object 346 onto locomotive 310 as seen in FIGS. 9A and 9B.

Mounted within and adjacent to second side panel 404 is a multi-function switch assembly 428 which preferably provides an on-off switching function as well as a music selection function, and which normally is operated by an adult. Mounted within and underneath top element 406 is a push switch 430, which may be operated by a child and which actuates motion of the locomotive 310 and music generation if switch 428 is in an ON operative position.

Disposed interiorly of first and second side panels 402 and 404 is a battery case 440 which typically engages three batteries 442 and has a cover 446 which is selectably openable from the outside of the locomotive 310.

Bottom element 407 includes a generally planar portion 452 and includes first and second pairs 454 and 456 of wheel supports. Driven wheels 408, which are each fixed to an opposite end of an axle 458, are rotatably supported on axle connector portions 450 thereof onto pair 454 of wheel supports. A second pair of wheels 468, which are each fixed to an opposite end of an axle 470, are rotatably supported on axle connector portions 472 thereof onto pair 456 of wheel supports.

Generally planar portion 452 of bottom element 407 also defines a seat for multi-axial gear assembly 410, which seat is bounded by parallel upstanding side wall portions 480 and 482 and by an upstanding transverse wall portion 484.

Extending downwardly from planar portion 452 is a socket 490 which rotatably accommodates power take off 312, which is, in turn, driven by multi-axial gear assembly 410. It is noted that a pair of outwardly extending transversely directed wing portions 492 extend from socket 490 at a location spaced from planar portion 452. These wing portions 492 are typically engaged between top and bottom track portions 304 and 306 and retain the locomotive against inadvertent disengagement from the track 302. A screw socket 494 is provided for receiving a screw (not shown) which retains multi-axial gear assembly 410 tightly against bottom element 407 and in the seat described above.

A pair of direction changing switch assemblies 496 and 498 are pivotably mounted onto mutually opposite ends of side panel 404 and each include a tongue portion 500 which extends through a corresponding aperture 502 formed in generally planar portion 452 of bottom element 407. Tongues 500 engage either one of locomotive direction changing switch engagement protrusion 332 and end 343 as the locomotive reaches either end of the track, thereby operating switch assemblies 496 and 498 to change the displacement direction of the locomotive 310 accordingly. It is appreciated that switch assemblies 496 and 498 are electrically connected to an electrical control circuit 510, to which switch assembly 428, switch 430 and gear assembly 410 are also connected.

Power take off 312 includes a generally cylindrical housing portion 520 having a driving slot 522 having a generally rectangular cross section for receiving a correspondingly configured drive shaft. Power take off 312 preferably includes a magnet 524 and a bottom housing portion 526, which is fixedly sealed to generally cylindrical housing portion 520, thereby enclosing magnet 524.

Figure 6A:
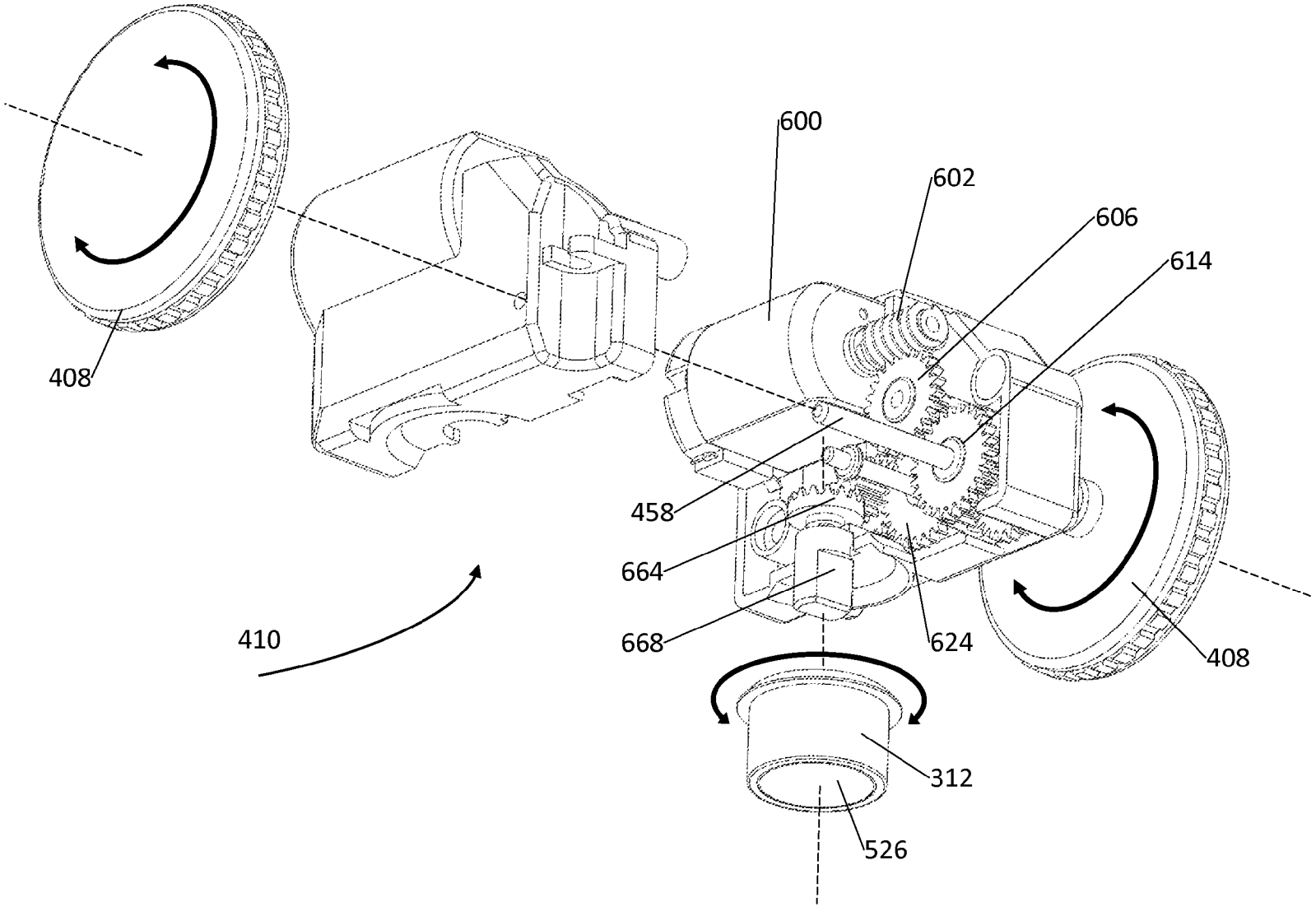
FIGS. 6A & 6B are respective simplified partially assembled and partially exploded view illustrations of a motor and a multi-axial gear assembly forming part of the multi-axial locomotive of FIGS. 4A, 4B & 5 in accordance with one embodiment of the present invention.
Figure 6B:
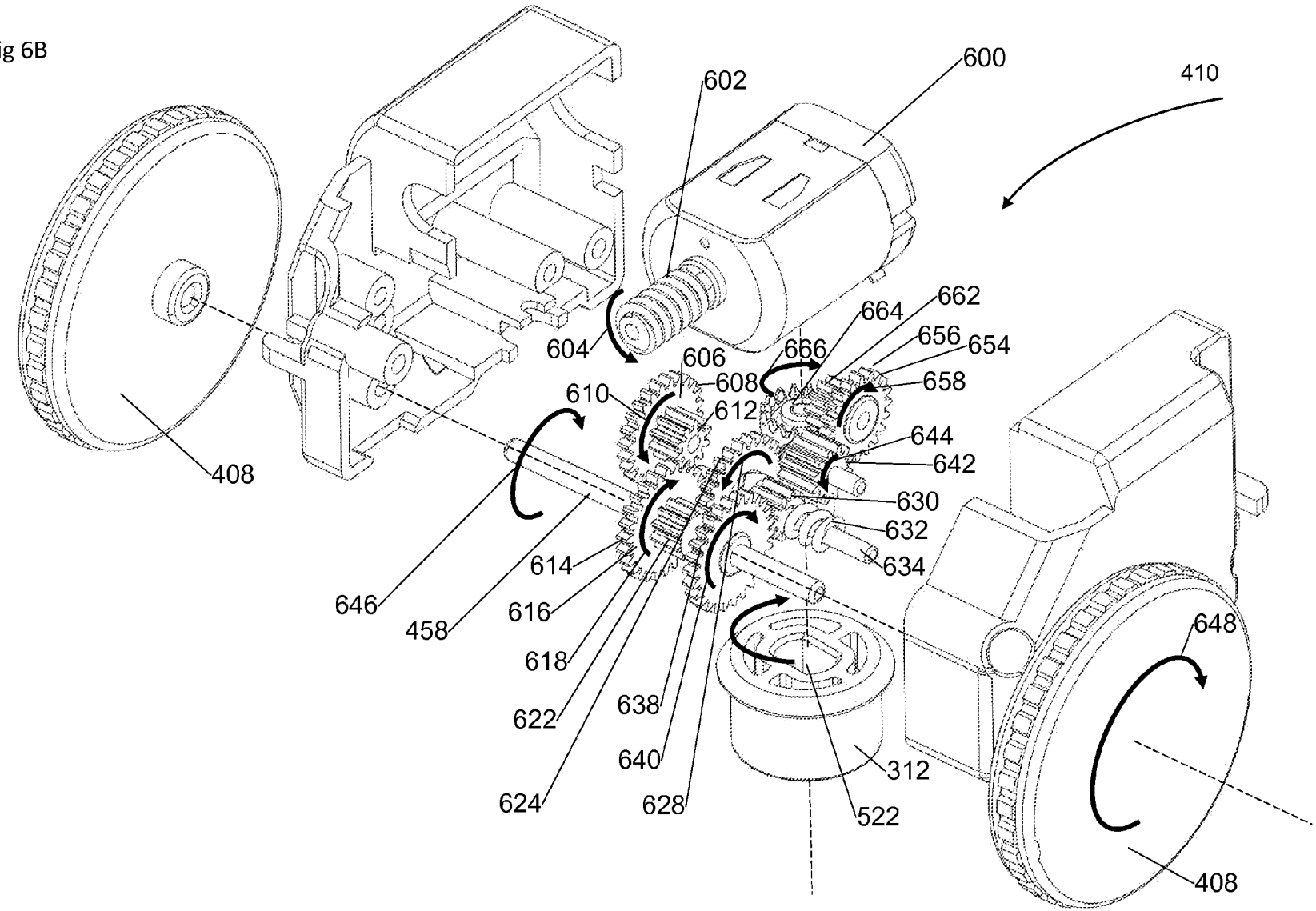

Reference is now made to FIGS. 6A & 6B, which are respective simplified partially assembled and partially exploded view illustrations of a motor and a multi-axial gear assembly forming part of the multi-axial locomotive of FIGS. 4A, 4B & 5 in accordance with one embodiment of the present invention.

As seen in FIGS. 6A and 6B, a reversible direction electric motor 600 drives a worm gear 602 typically in a direction indicated by an arrow 604. Worm gear 602 drives a relatively larger gear portion 606 of a first double gear 608 typically in a direction indicated by an arrow 610. A relatively smaller gear portion 612 of double gear 608 drives a relatively larger gear portion 614 of a second double gear 616 typically in a direction indicated by an arrow 618. Second double gear 616 is rotatably mounted onto an axle 458 onto which driven wheels 408 are fixedly mounted for rotation therewith.

A relatively smaller gear portion 622 of second double gear 616 drives a gear 624 typically in a direction indicated by an arrow 628. Gear 624 is coupled via a spring biased clutch to a gear 630. The spring biased friction clutch is defined by mutually facing clutch surfaces (not shown) on gears 624 and 630 which are forced together by a spring 632. Gears 624 and 630 and spring 632 are all rotatably mounted onto an axle 634. Gear 630 rotates typically in the direction indicated by arrow 628 and simultaneously drives a gear 638, typically in a direction indicated by an arrow 640, and a gear 642, typically in a direction indicated by an arrow 644.

Gear 638 is fixed to axle 458 and thus its rotation drives wheels 408 in the direction of rotation of gear 638, as indicated by arrows 646 and 648.

Gear 642 drives a relatively larger gear portion 654 of a third double gear 656 typically in a direction indicated by an arrow 658. A relatively smaller gear portion 662 of double gear 656 drives a gear 664 typically in a direction indicated by an arrow 666. Gear 664 is fixed to a drive shaft 668 which has a generally rectangular cross-section configuration suitable for driving seated engagement in driving slot 522 of power take off 312.

Figure 7A:
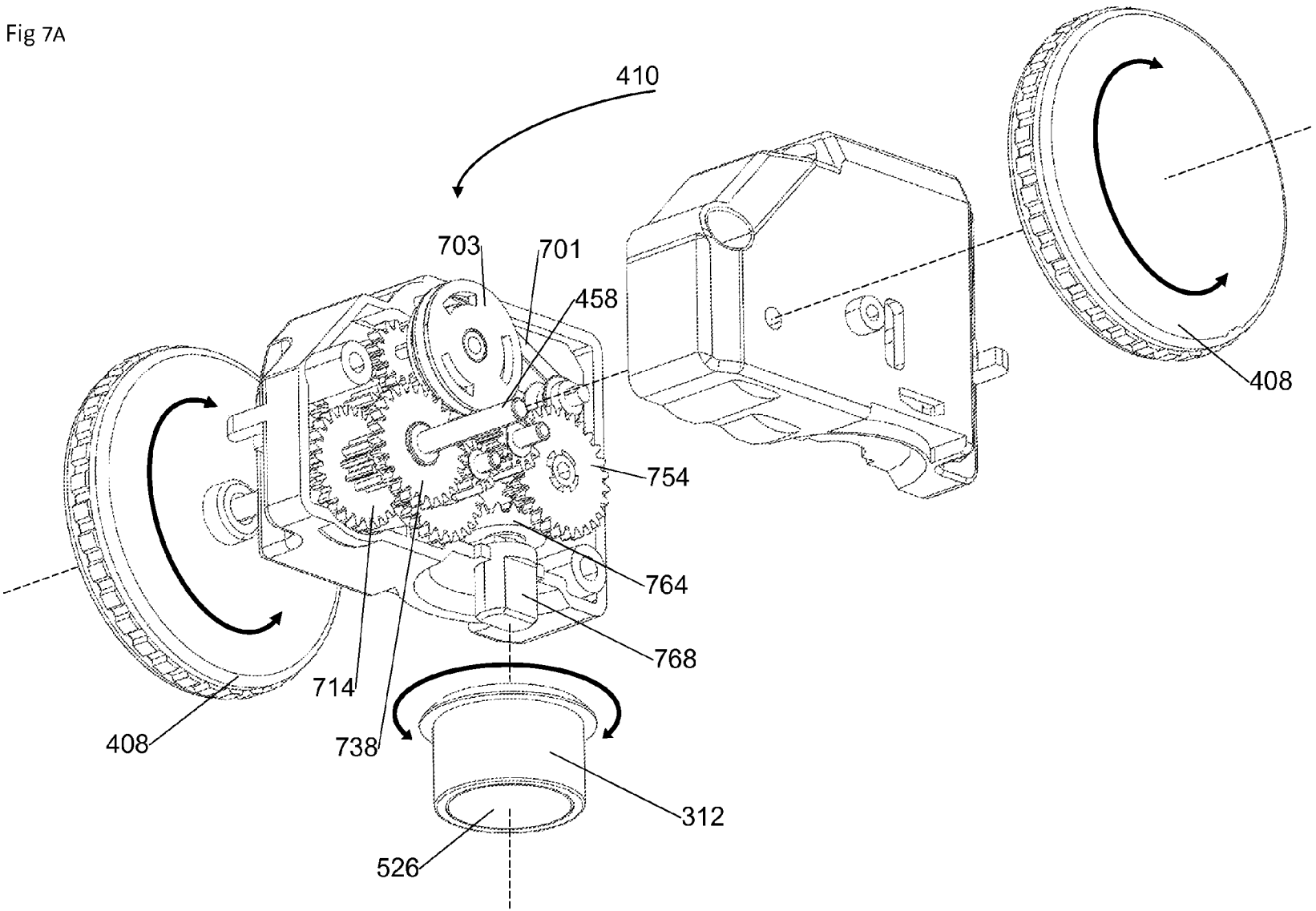
FIGS. 7A & 7B are respective simplified partially assembled and partially exploded view illustrations of a multi-axial gear assembly forming part of the multi-axial locomotive of FIGS. 4A, 4B & 5 in accordance with another embodiment of the present invention.
Figure 7B:
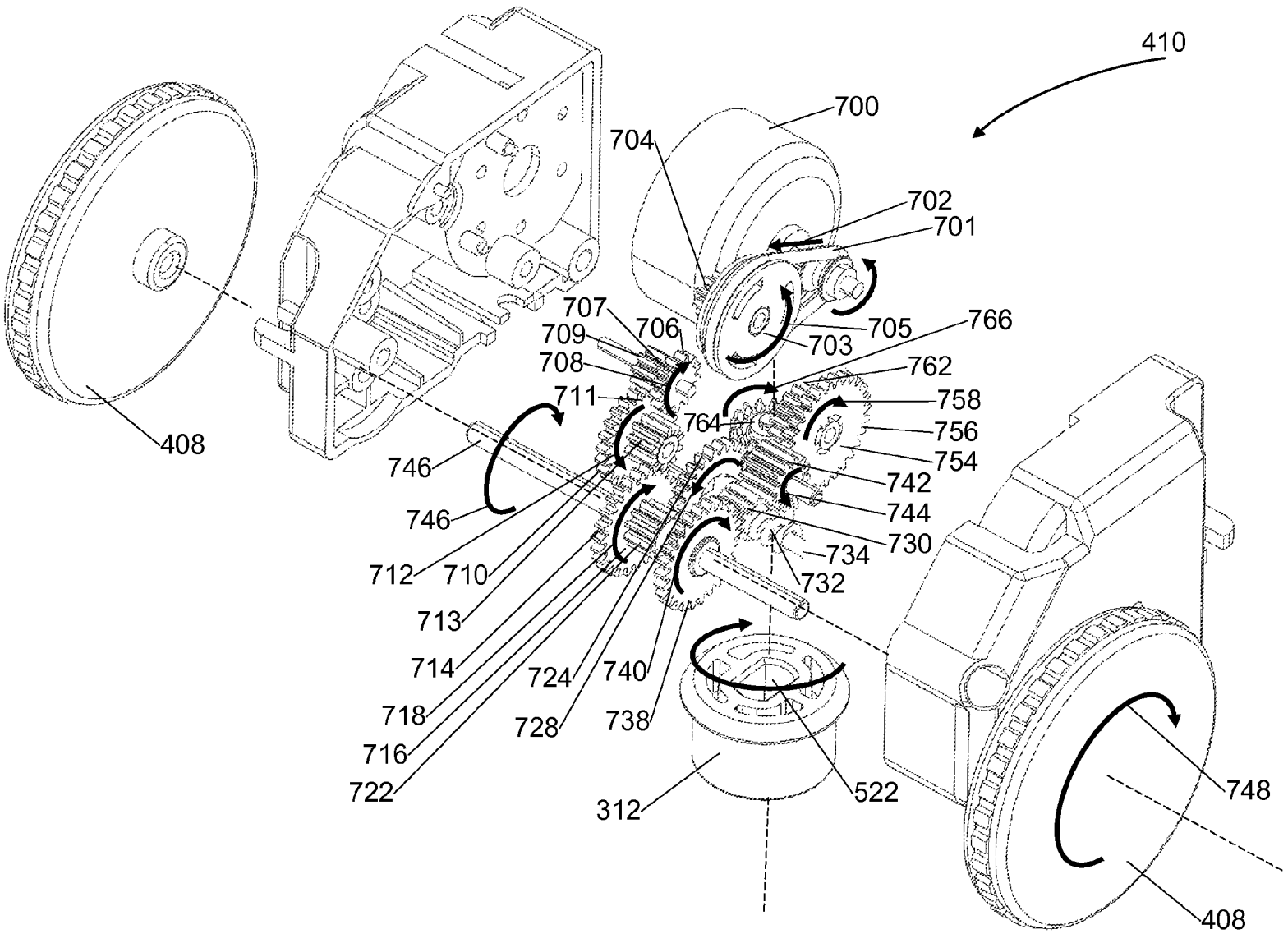

Reference is now made to FIGS. 7A & 7B, which are respective simplified partially assembled and partially exploded view illustrations of a motor and a multi-axial gear assembly forming part of the multi-axial locomotive of FIGS. 4A, 4B & 5 in accordance with another embodiment of the present invention.

As seen in FIGS. 7A and 7B, a reversible direction electric motor 700 drives a belt 701 typically in a direction indicated by an arrow 702. Belt 701 drives a belt wheel 703 which is fixed to a gear 704, both of which rotate in a direction indicated by an arrow 705. Gear 704 drives a relatively larger gear portion 706 of a first double gear 707 typically in a direction indicated by an arrow 708. A relatively smaller gear portion 709 of double gear 707 drives a relatively larger gear portion 710 of a second double gear 711 typically in a direction indicated by an arrow 712.

A relatively smaller gear portion 713 of double gear 711 drives a relatively larger gear portion 714 of a third double gear 716 typically in a direction indicated by an arrow 718. A relatively smaller gear portion 722 of double gear 716 drives a gear 724 typically in a direction indicated by an arrow 728. Gear 724 is coupled via a spring biased clutch to a gear 730. The spring biased friction clutch is defined by mutually facing clutch surfaces (not shown) on gears 724 and 730 which are forced together by a spring 732. Gears 724 and 730 and spring 732 are all rotatably mounted onto an axle 734. Gear 730 rotates typically in the direction indicated by arrow 728 and simultaneously drives a gear 738, typically in a direction indicated by an arrow 740, and a gear 742, typically in a direction indicated by an arrow 744.

Gear 738 is fixed to axle 458 and thus its rotation drives wheels 408 in the direction of rotation of gear 738, as indicated by arrows 746 and 748.

Gear 742 drives a relatively larger gear portion 754 of a fourth double gear 756 typically in a direction indicated by an arrow 758. A relatively smaller gear portion 762 of double gear 756 drives a gear 764 typically in a direction indicated by an arrow 766. Gear 764 is fixed to a drive shaft 768 which has a generally rectangular cross-section configuration suitable for driving seated engagement in driving slot 522 of power take off 312.

Figure 10A:
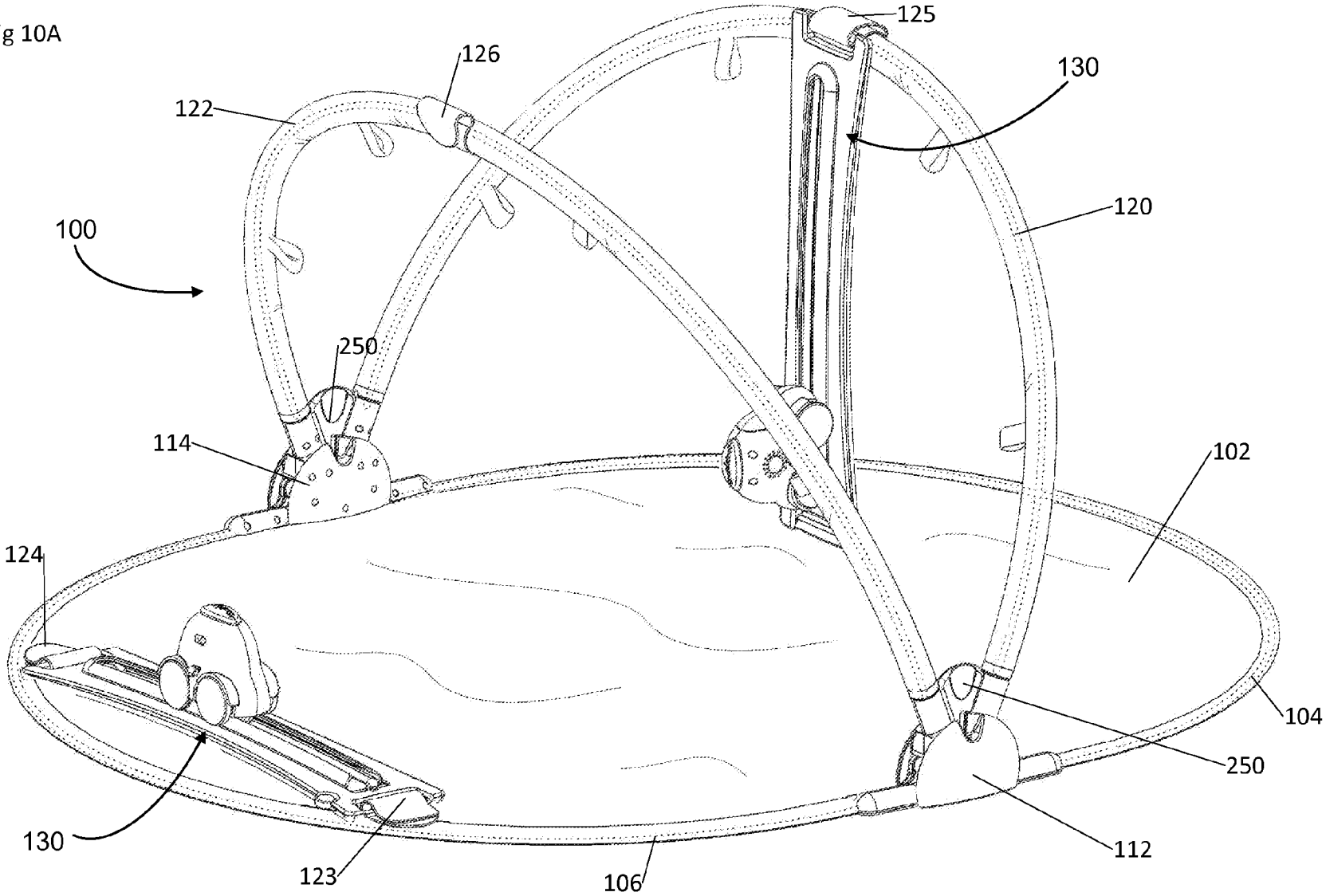
FIGS. 10A, 10B, and 10C are simplified illustrations of the activity center of FIGS. 1A-9B in respective fully open, intermediate and transportable operative orientations.
Figure 10B:
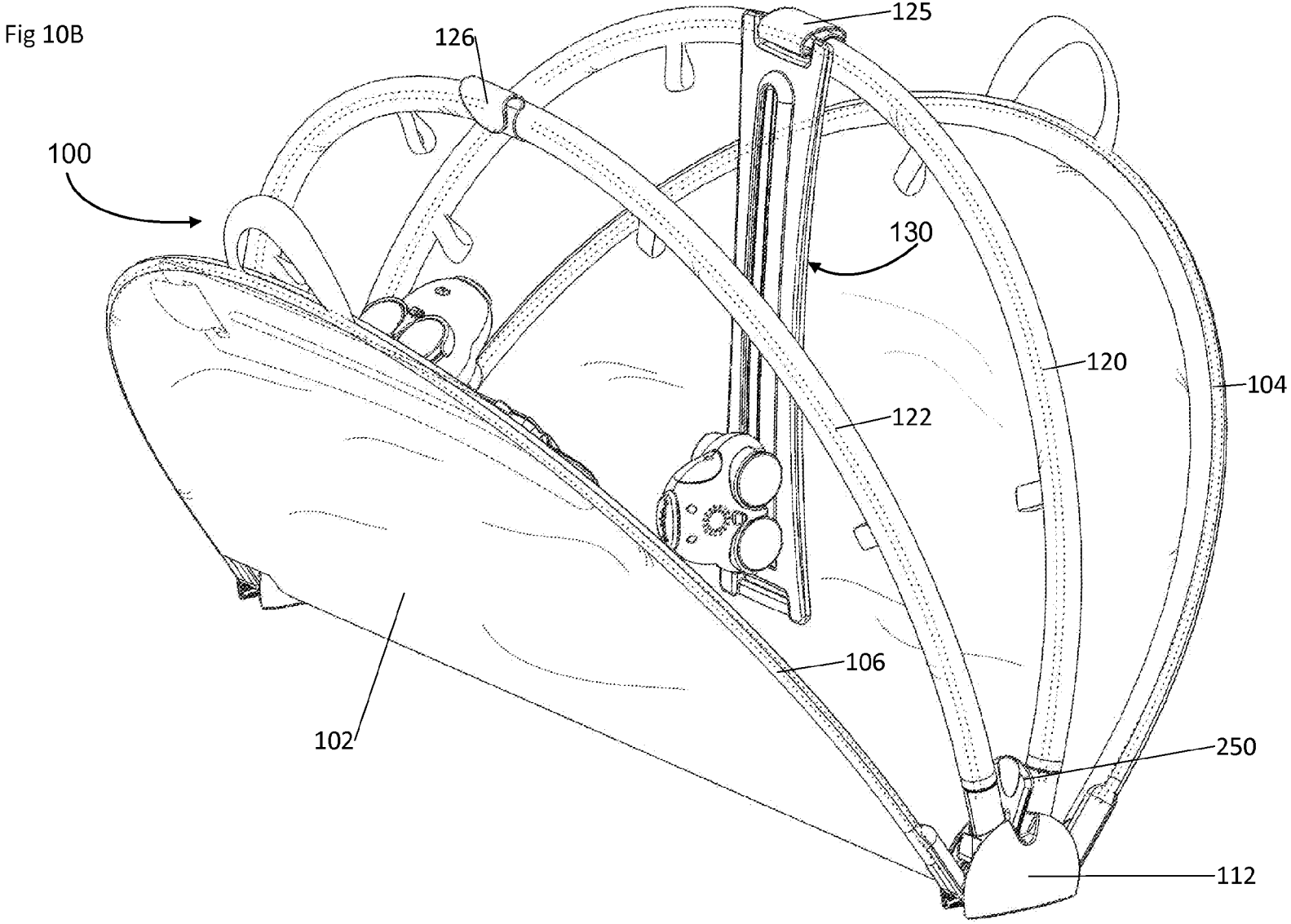
Figure 10C:
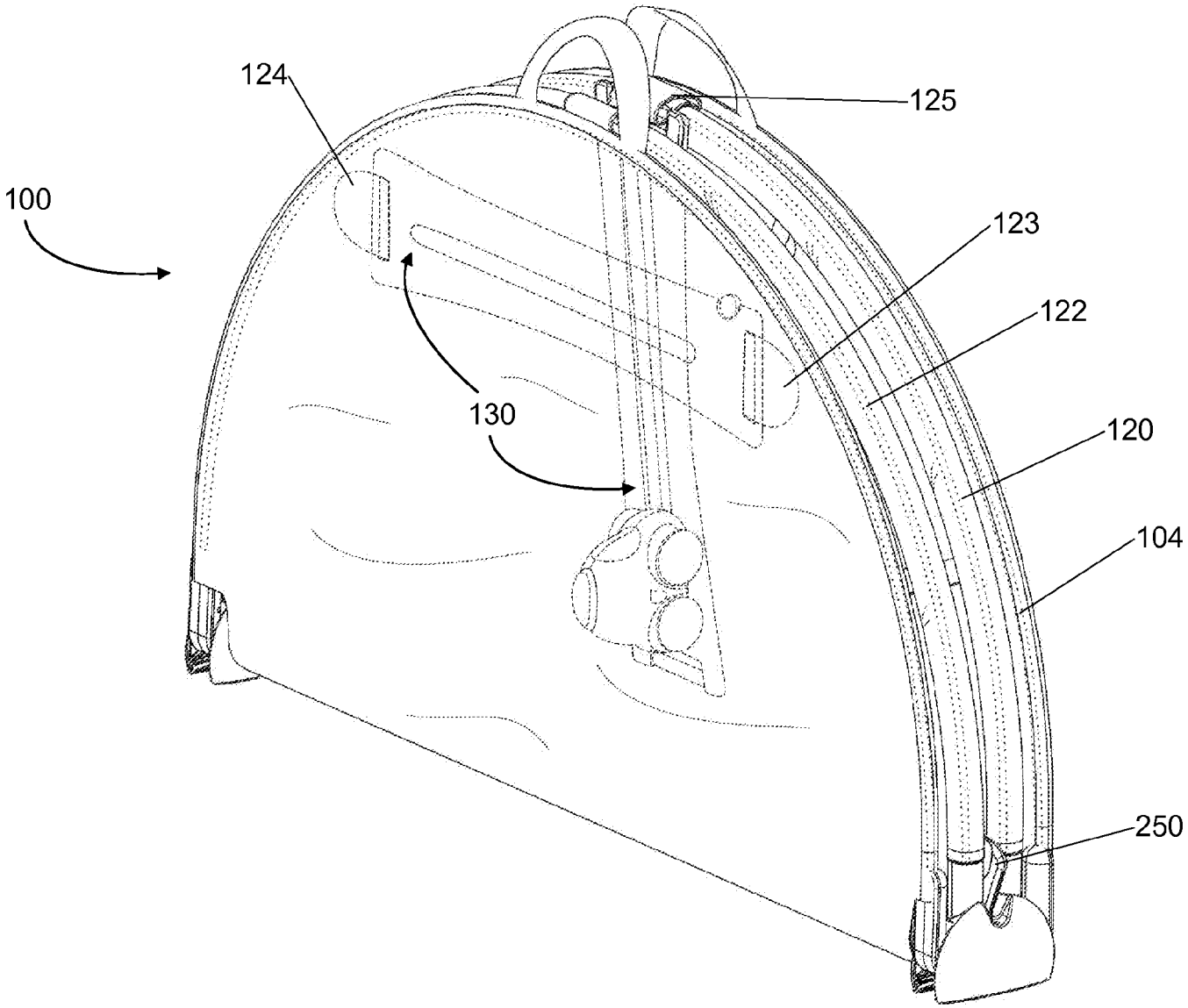

Reference is now made to FIGS. 10A, 10B, and 10C, which are simplified illustrations of the activity center of FIGS. 1A-9B in respective fully open, intermediate and transportable operative orientations. It is a particular feature of an embodiment of the present invention that when in a fully open orientation, as shown in FIG. 10A, arc mounting and positioning subassemblies 112 and 114 selectably lock first and second pairs of circumferential elements 104, 106, 120 and 122 in their respective open operative orientations and prevent inadvertent collapse thereof.

FIG. 10B shows the activity center of FIGS. 1A-9B and 10A partially folded to an intermediate operative orientation following unlocking of arc mounting and positioning subassemblies 112 and 114 by rotation of arbors 250 through 90 degrees with respect to their locking orientations as shown in FIG. 10A. FIG. 10C shows the activity center of FIGS. 1A-10B in a fully folded operative orientation suitable for transportation and storage.

It is a particular feature of the present invention that in the intermediate and fully folded orientations shown in FIGS. 10B & 10C, the decouplable reciprocating and rotating movement subassembly 130 may remain fully mounted onto pad 102 and partially mounted onto elements 120 and 122 by respective mounting tabs 125 and 126.

Figure 12B:
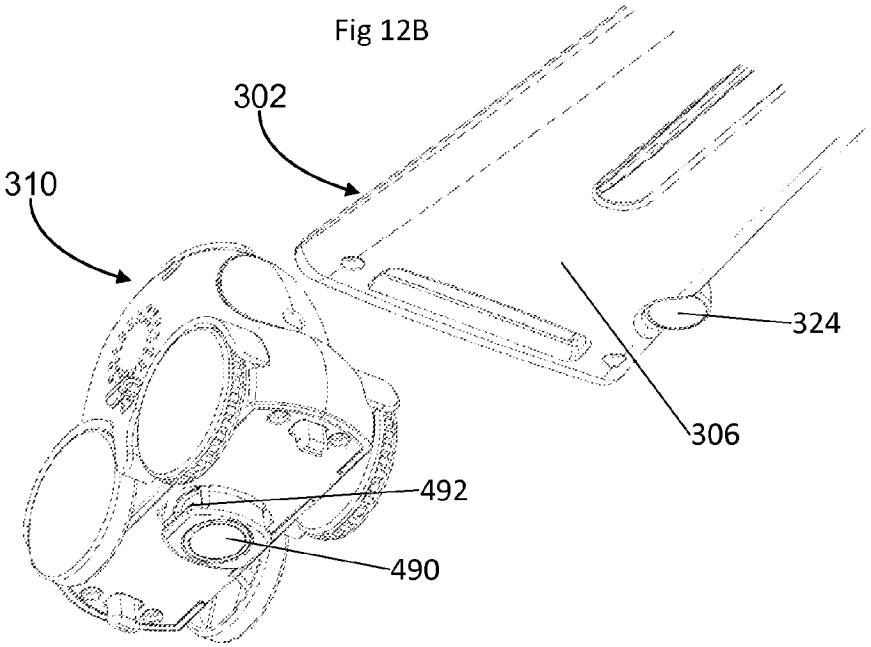
FIGS. 12A, 12B and 12C are respective partial top view, bottom view and sectional view of the decouplable reciprocating and rotating movement subassembly forming part of the activity center of FIGS. 1A-9B in a first operative orientation.
Figure 12A:
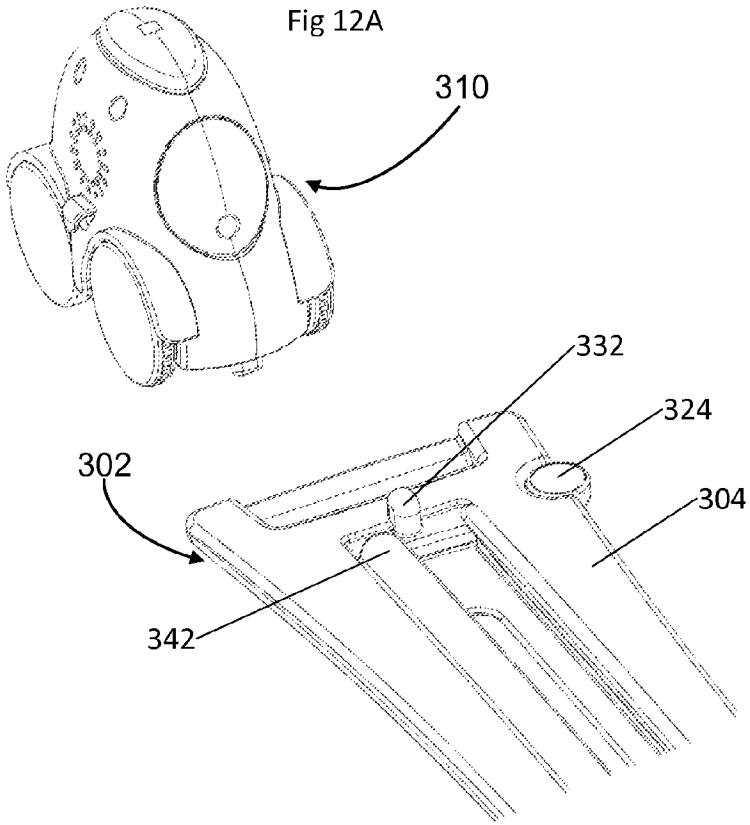
Figure 12C:
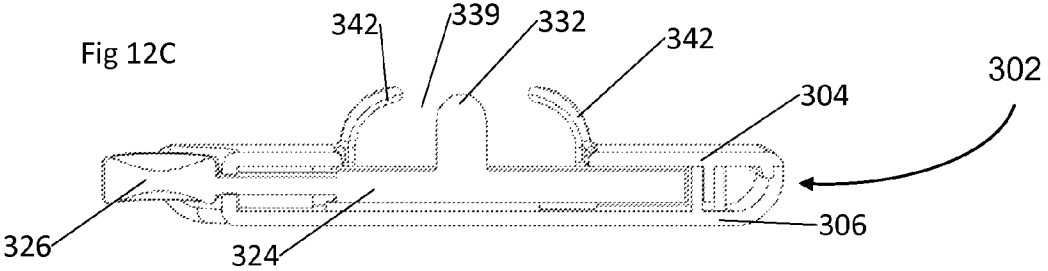

Reference is now made to FIGS. 12A, 12B and 12C, which are respective partial top view, bottom view and sectional view of the decouplable reciprocating and rotating movement subassembly forming part of the activity center of FIGS. 1A-9B in a first operative orientation. FIGS. 12A-12C show an operative orientation wherein the locomotive 310 is disengaged from the track 302 and the slidable finger-engageable track end locking element 324 is in a locked position, wherein protrusion 332 is in a blocking orientation with respect to the track.

Figure 13B:
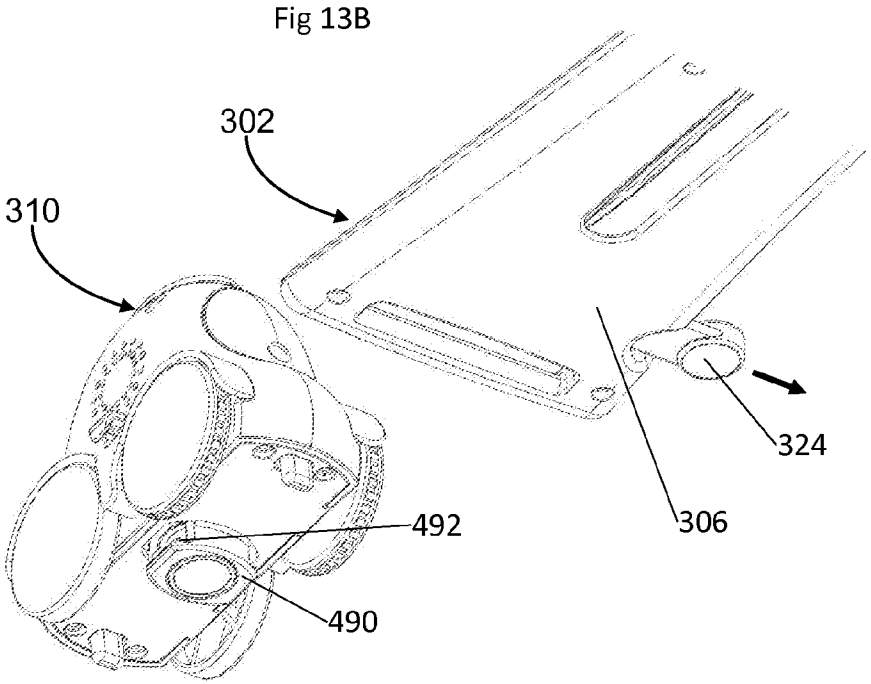
FIGS. 13A, 13B and 13C are respective partial top view, bottom view and sectional view of the decouplable reciprocating and rotating movement subassembly forming part of the activity center of FIGS. 1A-9B in a second operative orientation.
Figure 13A:
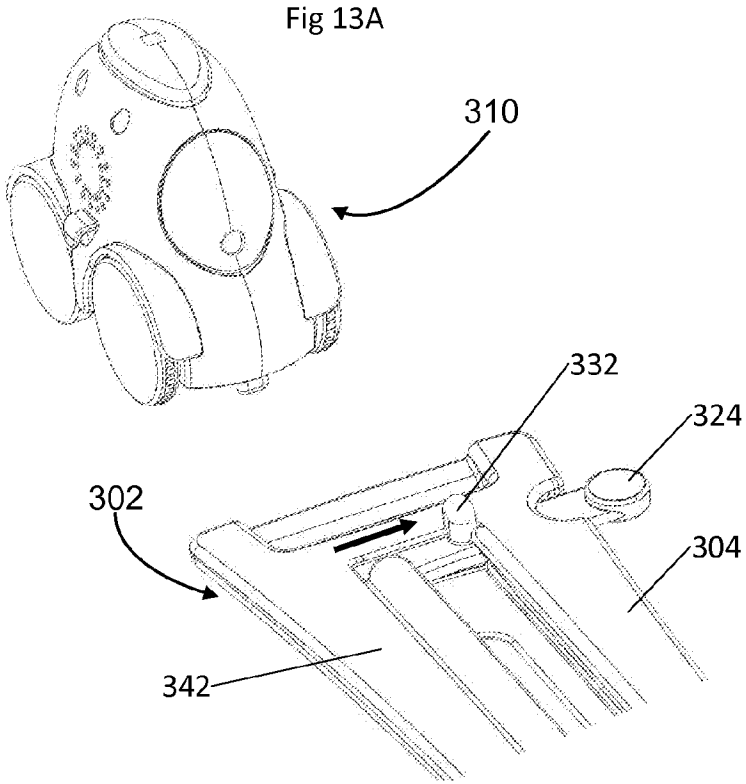
Figure 13C:
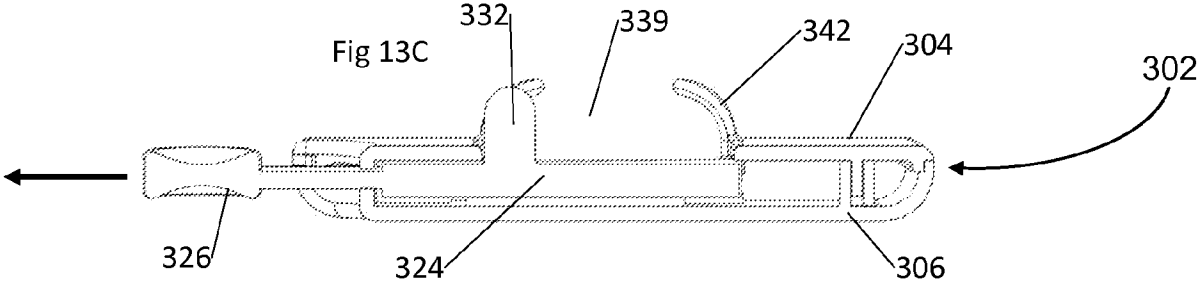

Reference is now made to FIGS. 13A, 13B and 13C, which are respective partial top view, bottom view and sectional view of the decouplable reciprocating and rotating movement subassembly forming part of the activity center of FIGS. 1A-9B in a second operative orientation. Here the locomotive 310 is disengaged from the track 302 but the slidable finger-engageable track end locking element 324 has been displaced transversely relative to track 302 into an unlocked position, wherein protrusion 332 is in a non-blocking orientation with respect to the track.

Figure 14B:
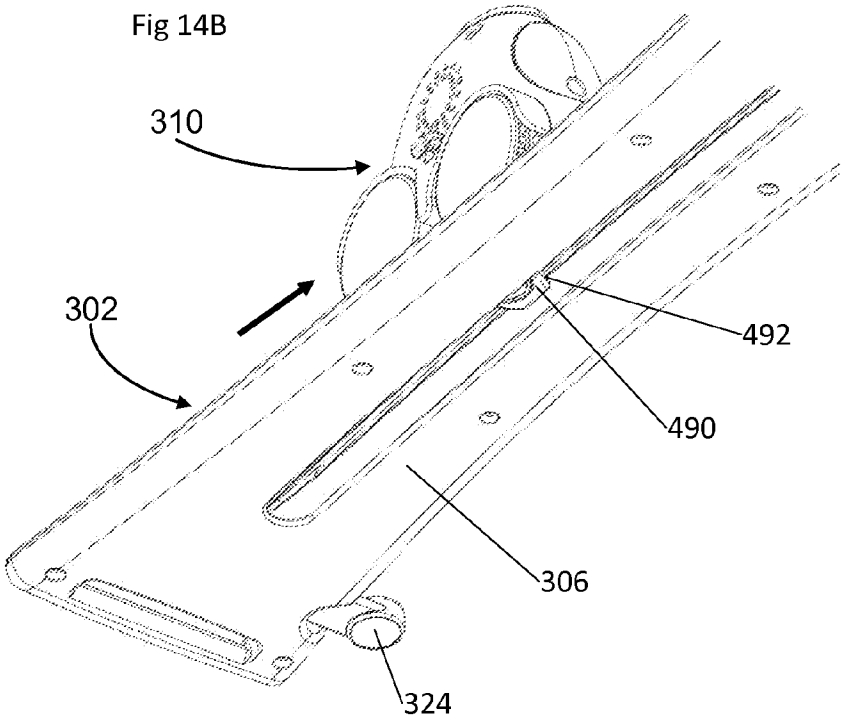
FIGS. 14A, 14B and 14C are respective partial top view, bottom view and sectional view of the decouplable reciprocating and rotating movement subassembly forming part of the activity center of FIGS. 1A-9B in a third operative orientation.
Figure 14A:
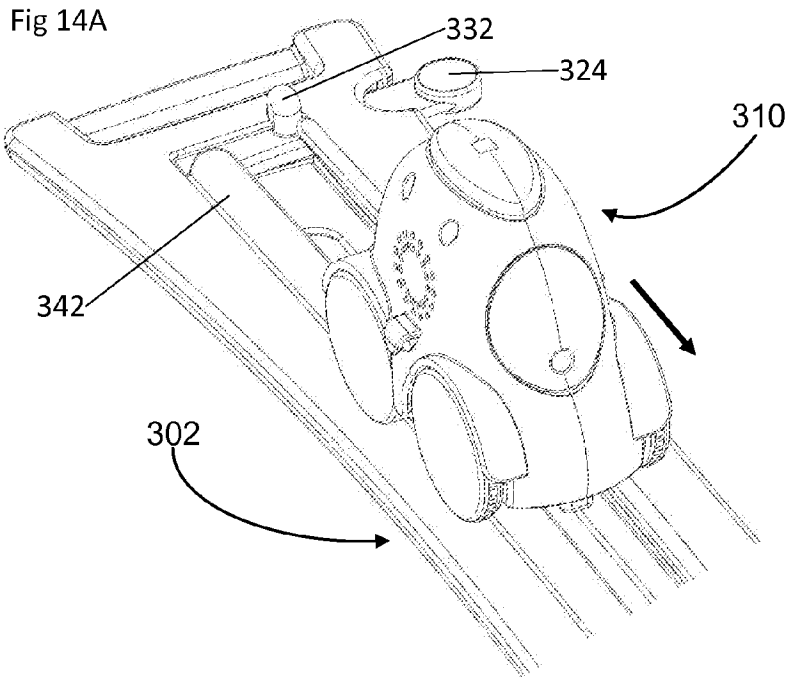
Figure 14C:
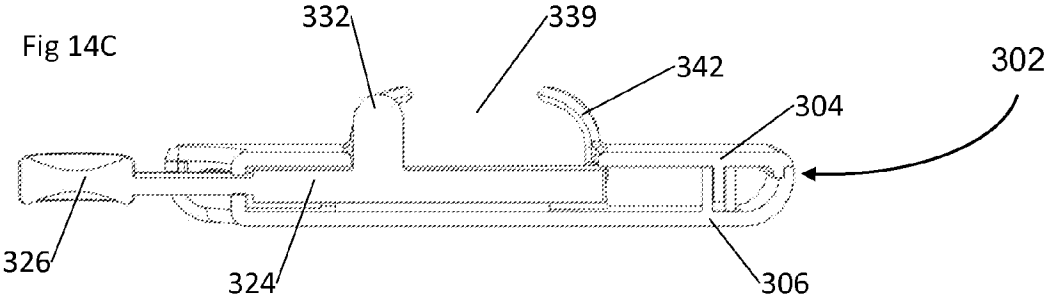

Reference is now made to FIGS. 14A, 14B and 14C, which are respective partial top view, bottom view and sectional view of the decouplable reciprocating and rotating movement subassembly forming part of the activity center of FIGS.

1A-9B in a third operative orientation. Here the locomotive 310 is displaceably engaged with the track 302 with socket 490 being located between top and bottom track elements 304 and 306 but the slidable finger-engageable track end locking element 324 remains in its unlocked position, wherein protrusion 332 is in a non-blocking orientation with respect to the track.

Figure 15B:
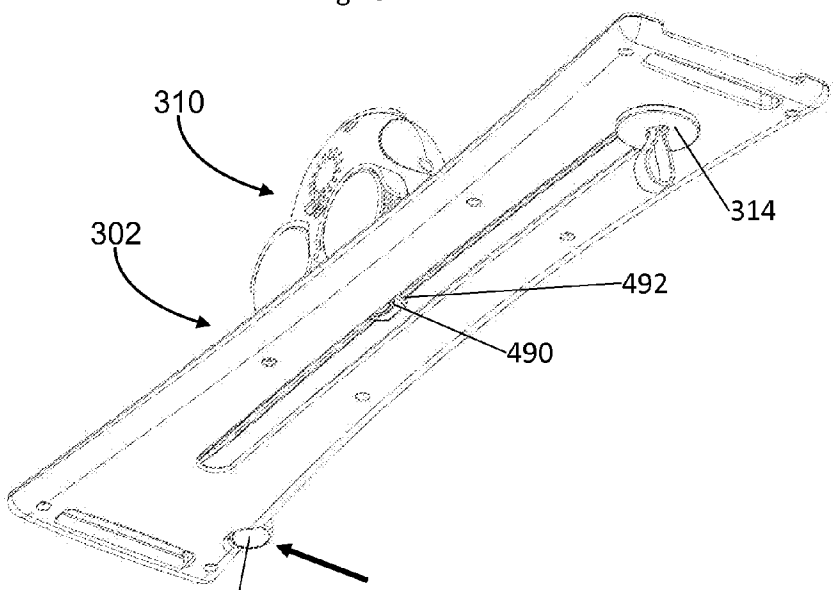
FIGS. 15A, 15B and 15C are respective partial top view, bottom view and sectional view of the decouplable reciprocating and rotating movement subassembly forming part of the activity center of FIGS. 1A-9B in a fourth operative orientation.
Figure 15A:
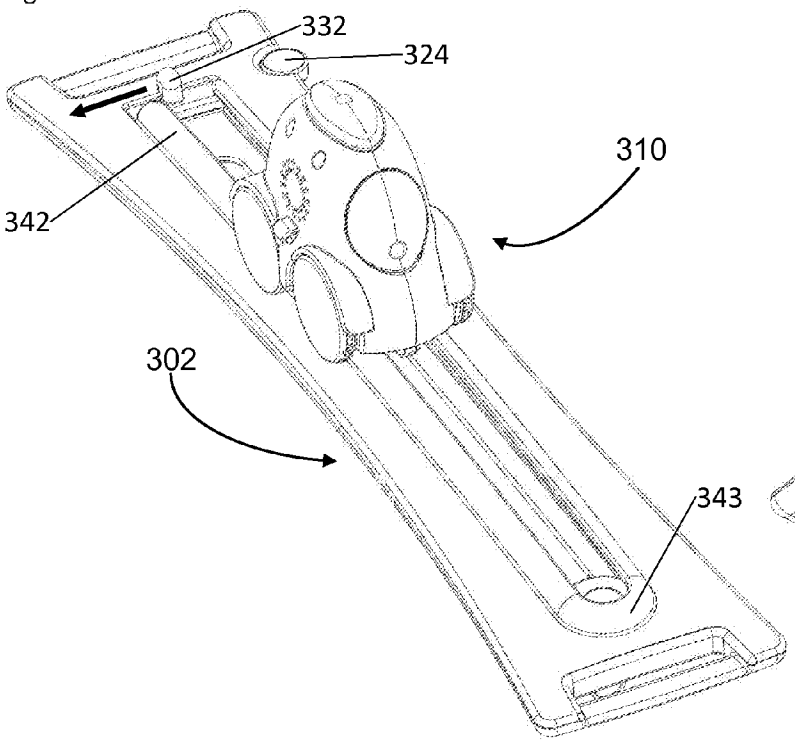
Figure 15C:
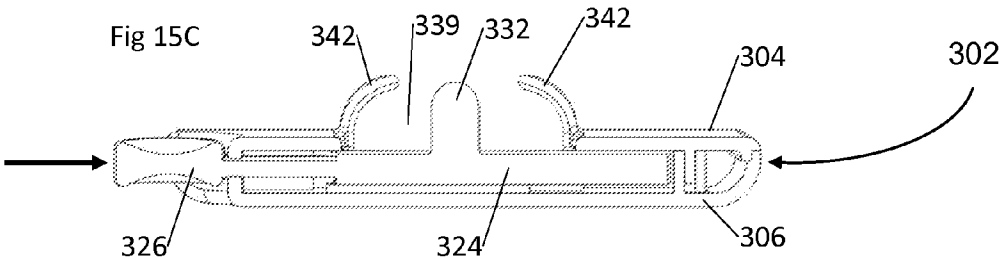

Reference is now made to FIGS. 15A, 15B and 15C, which are respective partial top view, bottom view and sectional view of the decouplable reciprocating and rotating movement subassembly forming part of the activity center of FIGS. 1A-9B in a fourth operative orientation. Here the locomotive 310 is displaceably engaged with the track 302 with socket 490 being located between top and bottom track elements 304 and 306 and the slidable finger-engageable track end locking element 324 is in its locked position, wherein protrusion 332 is in a blocking orientation with respect to the track. In this orientation, by virtue of the engagement of the socket 490 between top and bottom track elements 304 and 306, locomotive 310 cannot be disengaged from the track 302. It is noted, however that the power take off 312 is not engaged by the decouplable connector assembly 314, which is seen to be at a location along the track 302 spaced from the location of the locomotive 310.

Figures 16A, 16B, 16C:
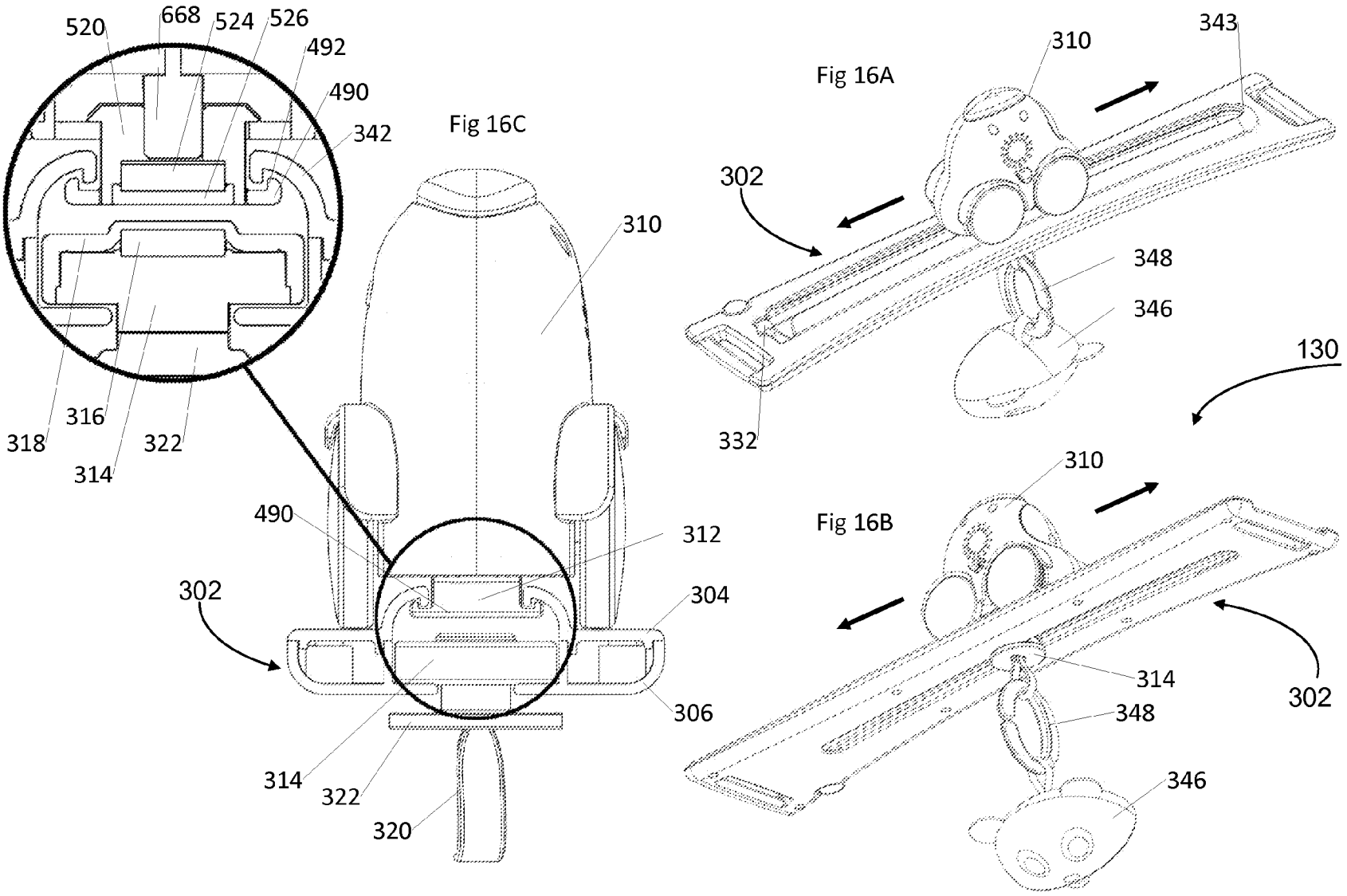
FIGS. 16A, 16B and 16C are respective partial top view, bottom view and sectional view of the decouplable reciprocating and rotating movement subassembly forming part of the activity center of FIGS. 1A-9B in a fifth operative orientation.

Reference is now made to FIGS. 16A, 16B and 16C, which are respective partial top view, bottom view and sectional view of the decouplable reciprocating and rotating movement subassembly forming part of the activity center of FIGS. 1A-9B in a fifth operative orientation. Here it is seen that decouplable connector assembly 314 has been translated along track 302 to a location underlying power take off 312 but is not yet coupled thereto. Accordingly rotational movement of power take off 312 is not transmitted to rotatable fanciful object 346. Locomotive 310 may move back and forth along track 302 but does not move decouplable connector assembly 314 therewith.

It is appreciated that repeated back and forth motion of locomotive 310 is provided by repeated engagement of either of direction changing switches 496 and 498 of locomotive 310 with protrusion 332 followed by engagement with the raised circumferential rim 342 at end 343 of slot 339 or vice versa.

Figures 17A, 17B, 17C:
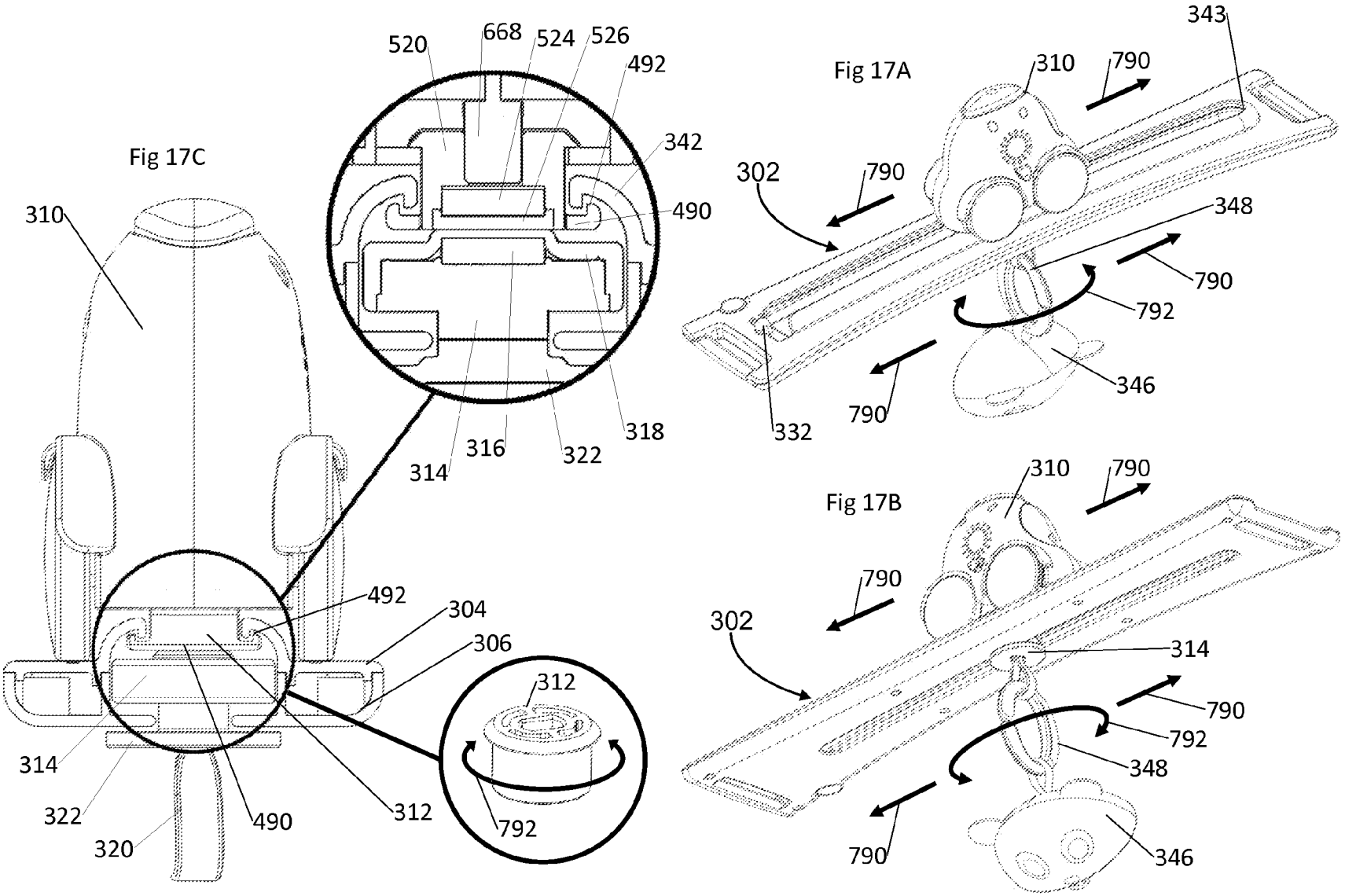
FIGS. 17A, 17B and 17C are respective partial top view, bottom view and sectional view of the decouplable reciprocating and rotating movement subassembly forming part of the activity center of FIGS. 1A-9B in a sixth operative orientation.

Reference is now made to FIGS. 17A, 17B and 17C, which are respective partial top view, bottom view and sectional view of the decouplable reciprocating and rotating movement subassembly forming part of the activity center of FIGS. 1A-9B in a sixth operative orientation which is identical to that of FIGS. 16A-16C, except that here decouplable connector assembly 314 has been translated along track 302 to a location underlying power take off 312 and power take off 312 is coupled to decouplable connector assembly 314. This coupling normally takes place automatically due to the magnetic attraction between magnet 524 of power take off 312 and magnet 316 of decouplable connector assembly 314, once the decouplable connector assembly 314 and the locomotive are in the mutual orientations shown in FIGS. 16A-16C.

It is appreciated that in the operative orientation of FIGS. 17A-17C, translational and rotational movement of power take off 312 is transmitted to rotatable fanciful object 346 as indicated by respective arrows 790 and 792.

Figures 18A, 18B:
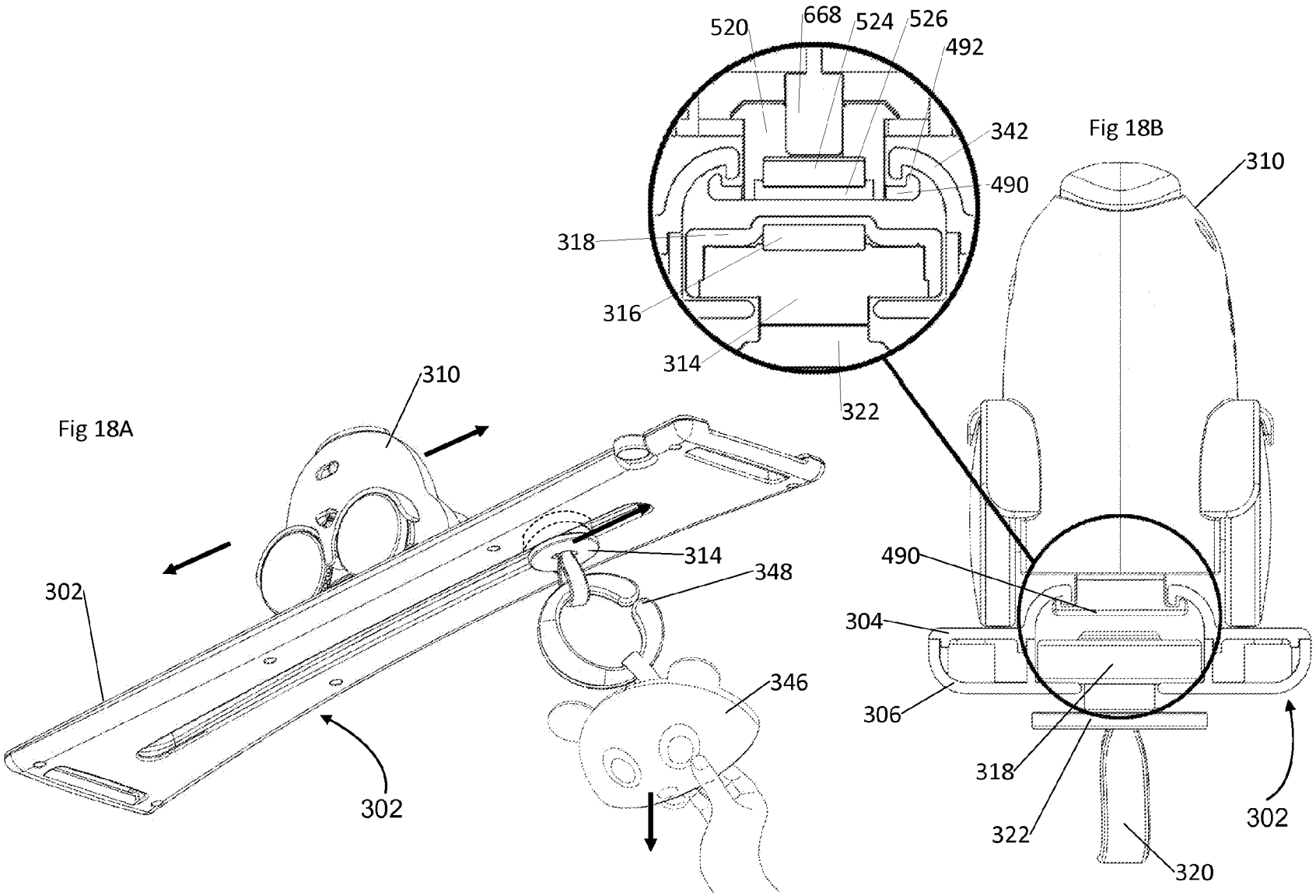
FIGS. 18A and 18B are respective partial bottom view and sectional view of the decouplable reciprocating and rotating movement subassembly forming part of the activity center of FIGS. 1A-9B in an eighth operative orientation.

Reference is now made to FIGS. 18A and 18B, which are respective partial bottom view and sectional view of the decouplable reciprocating and rotating movement subassembly forming part of the activity center of FIGS. 1A-9B in an eighth operative orientation which is identical to that of FIGS. 17A-17C, except that here decouplable connector assembly 314 has been decoupled from power take off 312. This decoupling normally takes place automatically when a child pulls on rotatable fanciful object 346 and thus applies a force as indicated by an arrow 796 which is sufficient to overcome the mutual attraction between magnet 524 of power take off 312 and magnet 316 of decouplable connector assembly 314. It is appreciated that in the decoupled operative orientation of FIGS. 18A-18C, neither translatory nor rotational motion produced by locomotive 310 is transmitted to decouplable connector assembly 314 or to rotatable fanciful object 346. It is a particular feature of the present invention that notwithstanding the aforesaid decoupling, neither rotatable fanciful object 346 nor decouplable connector assembly 314 becomes decoupled from track 302.

Figure 19A:
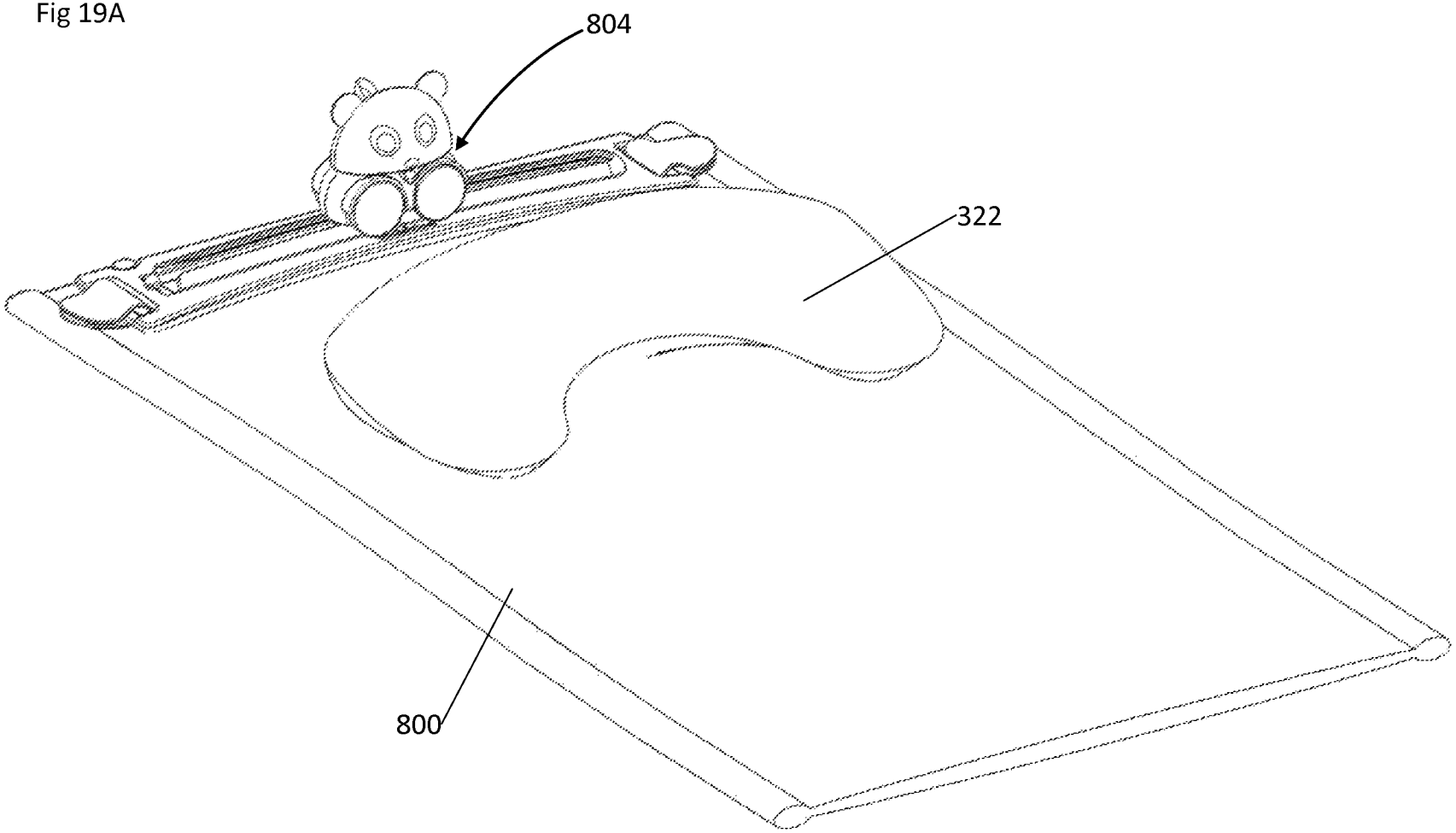
FIGS. 19A, 19B and 19C are simplified illustrations of a young child activity center constructed and operative in accordance with an alternative embodiment of the present invention in respective fully open, intermediate and transportable operative orientations.
Figure 19C:
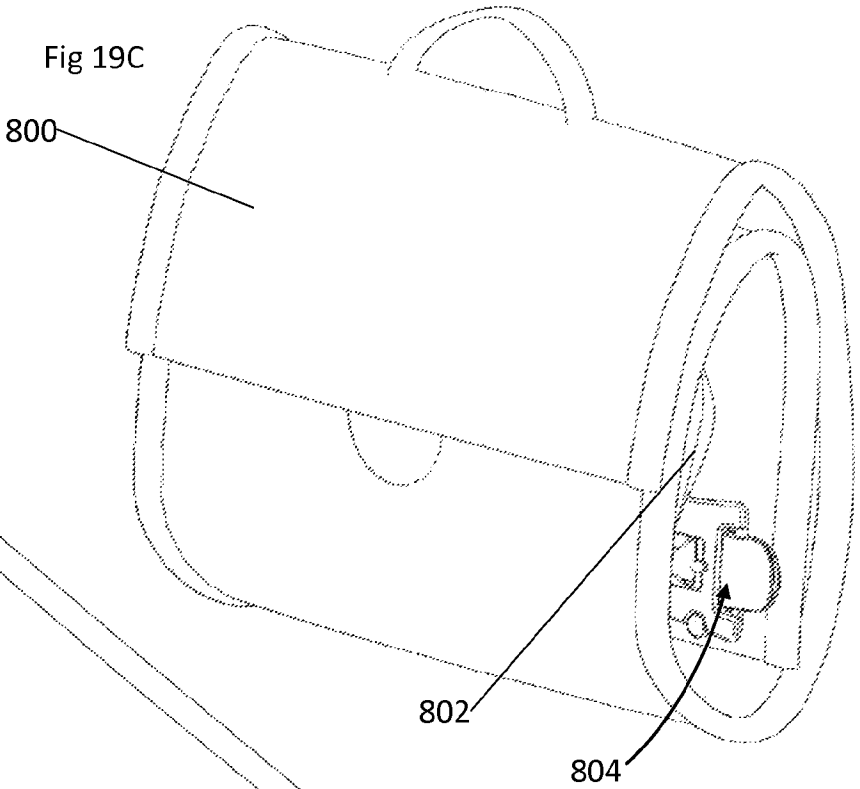
Figure 19B:
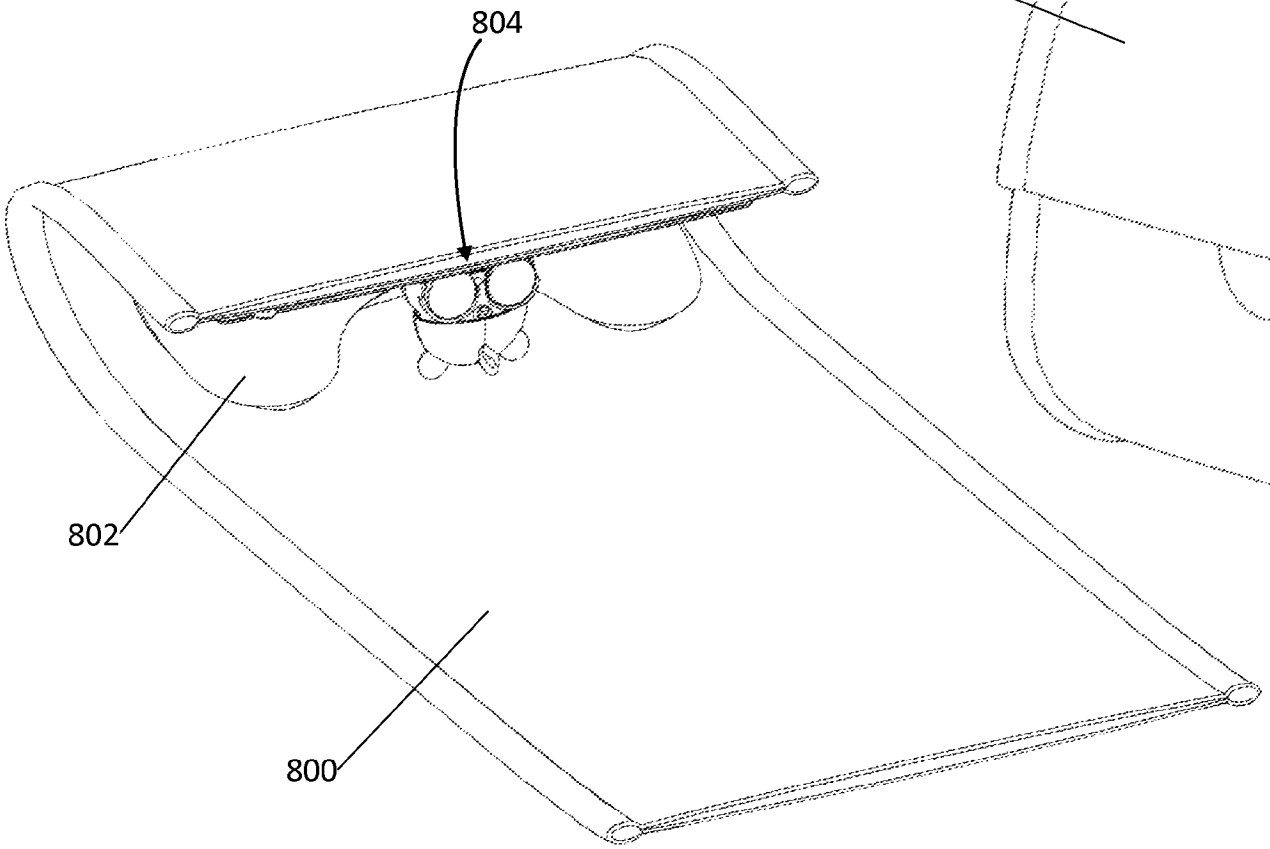

Reference is now made to FIGS. 19A, 19B and 19C, which are simplified illustrations of a young child activity center constructed and operative in accordance with an alternative embodiment of the present invention in respective fully open, intermediate and transportable operative orientations. The young child activity center of FIGS. 19A-19C typically comprises a foldable pad 800 having a child support pillow 802 removably attached thereto and having a reciprocating movement subassembly 804 removably mounted thereon. Reciprocating movement subassembly 804 may be identical to decouplable reciprocating and rotating movement subassembly 130 or may be an emasculated version thereof without a power take off and a decouplable connector assembly.

It is a particular feature of the embodiment of FIGS. 19A-19C that the pad 800 can be folded as shown in FIGS. 19B & 19C suitable for transport or storage, with child support pillow 802 and reciprocating movement assembly 804 attached thereto in their normal operative positions.

It will be appreciated by persons skilled in the art that the present invention is not limited to what has been particularly shown and described hereinabove. Rather the scope of the invention includes both combinations and subcombinations of the various features described hereinabove as well as modifications and variations thereof which would occur to persons skilled in the art upon reading the foregoing description and which are not in the prior art.

The invention claimed:

1. A developmental toy for infants comprising:

an infant support surface having an open operative orientation and a folded operative orientation;

a first pair of circumferential elements associated with said infant support surface and having an open operative orientation and a folded operative orientation;

a second pair of circumferential elements, generally similar in configuration to said first pair of circumferential elements, arranged to support toy objects above said infant support surface and having an open operative orientation and a folded operative orientation; and a locking assembly for selectably locking said first and second pairs of circumferential elements in their respective open operative orientations;

said open operative orientation of said infant support surface being an angular separation of 180 degrees, said open operative orientation of said first pair of circumferential elements being an angular separation of 180 degrees, and said open operative orientation of said second pair of circumferential elements being an angular separation of substantially less than 180 degrees.

2. A developmental toy for infants according to claim 1 and also comprising:

a track assembly including an upper track portion and a lower track portion which are fixed together to define a top track lying above said upper track portion, an intermediate track lying between said top track portion and said lower track portion and a bottom track lying below said lower track portion; and a locomotive assembly including a top portion which moves along said top track.

3. A developmental toy for infants according to claim 2 and also comprising at least one removably mounting element operative for removably mounting said track assembly on said second pair of elements.

4. A developmental toy for infants according to claim 3 and also comprising at least one removably mounting element operative for removably mounting said track assembly on said infant support surface.

5. A developmental toy for infants according to claim 3 and wherein said locomotive assembly also includes an intermediate portion which is decouplably connected to said top portion for travel along said intermediate track along with said top portion and a bottom portion which is fixed to said intermediate portion for travel along with said intermediate portion.

6. A developmental toy for infants according to claim 5 and wherein said intermediate portion of said locomotive assembly is at least lockable in an at least partially confined space between said upper track portion and a lower track portion and is thus retained against disengagement from said track assembly even when said intermediate portion is decoupled from said top portion of said locomotive assembly.

7. A developmental toy for infants according to claim 2 and also comprising at least one removably mounting element operative for removably mounting said track assembly on said infant support surface.

8. A developmental toy for infants according to claim 2 and wherein said locomotive assembly also includes an intermediate portion which is decouplably connected to said top portion for travel along said intermediate track along with said top portion and a bottom portion which is fixed to said intermediate portion for travel along with said intermediate portion.

9. A developmental toy for infants according to claim 8 and wherein:

said top portion of said locomotive assembly is operative to move along said top track and to provide a rotational driving output about an axis which is generally perpendicular to said track;

said intermediate portion of said locomotive assembly is operative to be decouplably driven by said top portion both in motion along said intermediate track and in rotational motion about said axis which is generally perpendicular to said track; and said bottom portion of said locomotive assembly is operative to be driven by said intermediate portion both in motion along said bottom track and in rotational motion about said axis which is generally perpendicular to said track.

10. A developmental toy for infants according to claim 8 and wherein said intermediate portion of said locomotive assembly is at least lockable in an at least partially confined space between said upper track portion and a lower track portion and is thus retained against disengagement from said track assembly even when said intermediate portion is decoupled from said top portion of said locomotive assembly.

11. A developmental toy for infants according to claim 1 and also comprising:

a base assembly including an upper base portion and a lower base portion which are fixed together to define a top base surface lying above said upper base portion, an at least partially confined base surface lying between said top base portion and said lower base portion and a bottom base surface lying below said lower base portion; and a motion assembly including a top portion which moves in a first manner on said top base surface.

12. A developmental toy for infants according to claim 11 and wherein said motion assembly also includes:

an intermediate portion which is decoublably connected to said top portion for movement on said at last partially confined base surface driven by said top portion; and a bottom portion which is fixed to said intermediate portion for movement along with said intermediate portion.

13. A developmental toy for infants according to claim 11 and also comprising at least one removably mounting element operative for removably mounting said base assembly on said infant support surface.

14. A developmental toy for infants according to claim 11 and also comprising at least one removably mounting element operative for removably mounting said track assembly on said second pair of elements.

15. A developmental toy for infants according to claim 14 and also comprising at least one removably mounting element operative for removably mounting said track assembly on said infant support surface.

16. A developmental toy for infants according to claim 14 and wherein said motion assembly also includes:

an intermediate portion which is decoublably connected to said top portion for movement on said at last partially confined base surface driven by said top portion; and a bottom portion which is fixed to said intermediate portion for movement along with said intermediate portion.

17. A developmental toy for infants according to claim 1 and also comprising:

an elongate track; and a vehicle configured for locomotive motion along said track within a field of view of an infant located on said infant support surface, said locomotive motion along said track being generally side to side motion in said infant's field of view.

18. A developmental toy for infants according to claim 17 and wherein said vehicle comprises a support for a depending visual attractant.

19. A developmental toy for infants according to claim 18 and wherein said vehicle comprises a rotating support for said depending visual attractant, causing rotation of said visual attractant about an axis transverse to that of said elongate track.

20. A developmental toy for infants comprising:

a base assembly including an upper base portion and a lower base portion which are fixed together to define a top base surface lying above said upper base portion, an at least partially confined base surface lying between said top base portion and said lower base portion and a bottom base surface lying below said lower base portion; and a motion assembly including a top portion which moves in a first manner on said top base surface, an intermediate portion which is decoublably connected to said top portion for movement on said at last partially confined base surface driven by said top portion and a bottom portion which is fixed to said intermediate portion for movement along with said intermediate portion.

21. A developmental toy for infants comprising:

a track assembly including an upper track portion and a lower track portion which are fixed together to define a top track lying above said upper track portion, an intermediate track lying between said top track portion and said lower track portion and a bottom track lying below said lower track portion; and a locomotive assembly including a top portion which moves along said top track, an intermediate portion which is decouplably connected to said top portion for travel along said intermediate track along with said top portion and a bottom portion which is fixed to said intermediate portion for travel along with said intermediate portion.

22. A developmental toy for infants according to claim 21 and wherein said intermediate portion of said locomotive assembly is at least lockable in an at least partially confined space between said upper track portion and a lower track portion and is thus retained against disengagement from said track assembly even when said intermediate portion is decoupled from said top portion of said locomotive assembly.

23. A developmental toy for infants according to claim 22 and wherein:

said top portion of said locomotive assembly is operative to move along said top track and to provide a rotational driving output about an axis which is generally perpendicular to said track;

said intermediate portion of said locomotive assembly is operative to be decouplably driven by said top portion both in motion along said intermediate track and in rotational motion about said axis which is generally perpendicular to said track; and said bottom portion of said locomotive assembly is operative to be driven by said intermediate portion both in motion along said bottom track and in rotational motion about said axis which is generally perpendicular to said track.

24. A developmental toy for infants comprising:

an infant support surface;

an elongate track configured to be mountable at a location raised with respect to said infant support surface;

a movable element configured for locomotive motion along said track within a field of view of an infant located on said infant support surface, said locomotive motion along said track being generally side to side motion in said infant's field of view, said movable element being selectably non-detachable from said track by said infant; and at least one visual attractant arranged for removable association with said movable element at least for motion therewith along said track, said infant support surface having an open operative orientation and a folded operative orientation; and said developmental toy also comprising:

a first pair of circumferential elements associated with said infant support surface and having an open operative orientation and a folded operative orientation;

a second pair of circumferential elements, generally similar in configuration to said first pair of circumferential elements, arranged to support toy objects above said infant support surface and having an open operative orientation and a folded operative orientation; and a locking assembly for selectably locking said first and second pairs of circumferential elements in their respective open operative orientations;

said open operative orientation of said infant support surface being an angular separation of 180 degrees, said open operative orientation of said pair of circumferential elements being an angular separation of 180 degrees, and said open operative orientation of said second first pair of circumferential elements being an angular separation of substantially less than 180degrees.

* * * * *